US005440990A

United States Patent [19]

Wiedefeld et al.

[11] Patent Number: 5,440,990

[45] Date of Patent: Aug. 15, 1995

[54] ELECTRONIC TIME FUZE

[75] Inventors: William G. Wiedefeld, Clermont, Fla.; Michael H. Peterson, Glendale, Calif.; William F. Cote, Windermere, Fla.

[73] Assignee: The Walt Disney Company, Burbank, Calif.

[21] Appl. No.: 122,637

[22] Filed: Sep. 16, 1993

[51] Int. Cl.[6] ..... F23Q 7/02

[52] U.S. Cl. ..... 102/215

[58] Field of Search ..... 102/206, 215, 218, 202.3, 102/200; 89/6, 6.5; 361/248, 249

[56] References Cited

U.S. PATENT DOCUMENTS

| | | | |
|---|---|---|---|
| 3,500,746 | 3/1970 | Ambrosini | 102/200 |
| 3,934,514 | 1/1976 | Dawkins | 102/217 |
| 4,409,897 | 10/1983 | Kirby et al. | 102/200 |
| 4,986,183 | 1/1991 | Jacob et al. | 102/215 |
| 5,097,765 | 3/1992 | Ziemba | 102/215 |
| 5,173,569 | 12/1992 | Pallanck et al. | 102/210 |

*Primary Examiner*—Daniel T. Pihulic
*Attorney, Agent, or Firm*—Hecker & Harriman

[57] ABSTRACT

An electronic time fuse for controlling and initiating the explosion of an explosive is provided. The fuse comprises a timing circuit, an energy storage means, and a explosion initiation means. The fuse is initially connected through a two-wire interface to a local control unit (LCU). The LCU tests the integrity of the fuse, charges the energy storage means, measures the clock accuracy of the fuse, compensates for any inaccuracy of the fuse clock, loads timing information into the fuse, and commands the fuse to begin a timing sequence toward explosion. The fuse responds to LCU commands. The fuse ignores signals present on the two-wire interface for a period of time after the command to begin the timing sequence toward explosion is given. The fuse also monitors the status of the two-wire interface and the signals present on it and resets the fuse to an inert state if any irregularities are detected.

16 Claims, 21 Drawing Sheets

FIG. 2

| | | |
|---|---|---|
| FIG. 2(A) | FIG. 2(B) | FIG. 2(C) |
| FIG. 2(D) | FIG. 2(E) | FIG. 2(F) |
| FIG. 2(G) | FIG. 2(H) | FIG. 2(I) |

TIMING CLOCK [A-1]
TIMING CLOCK [A-1]
225
221
223
222
211
212
213
TEST CLOCK
CLOCK
209
CLOCK OSCILLATOR
SOUT
201
202
CLKOUT
203
TCLK

FIG. 3

| | | |
|---|---|---|
| FIG. 3(A) | FIG. 3(B) | FIG. 3(C) |
| FID. 3(D) | FIG. 3(E) | FIG. 3(F) |

ELECTRONIC TIME FUZE

BACKGROUND OF THE INVENTION

1. Field of the Invention

The present invention relates to devices and techniques for controlling and initiating the explosion of explosives.

2. Background Art

Ever since explosives were first invented, attempts have been made to control and initiate their explosion. Since explosives can be harmful to anything in the vicinity of their explosion, fuzes have been developed to prevent explosion near those using the explosives and to cause explosion at the intended location of the explosion. Mechanical, chemical and electrical fuzes have been developed, as well as those relying on other physical principles and phenomena. Fuzes have been designed to provide sensitivity to elapsed time, proximity to a target, impact, and other factors. Fuzes often include a safety features to prevent inadvertent explosions. Some examples of attempts to control and initiate explosions are described below.

U.S. Pat. No. 3,739,726, issued to Pintell, discloses a fuze for ordnance projectiles to be launched from a vehicle, wherein the fuze is armed after separation from its launcher by mechanical closure of switches with the aid of a delayed-action squib detonating by an electric charge stored on a capacitor. The fuze system includes means for charging the above capacitor at the instant in time at which the projectile is launched. Pintell requires the capacitor to be charged with high current levels and does not allow charging to occur at lower current levels prior to the instant in time at which the projectile is launched. Furthermore, Pintell does not provide a means for discharging the capacitor once it has been charged so as to reset the fuze to an inert state.

U.S. Pat. No. 4,445,435, issued to Oswald, discloses an electronic delay blasting circuit comprising digital counting circuitry. A two-wire input is provided to a bridge rectifier. When power is applied across the two-wire input, the bridge rectifier provides rectified power to charge a capacitor. When the capacitor is sufficiently charged, the digital counter circuit is initialized. As long as power is applied across the two-wire input, the counter circuit does not count. When power is removed from the two-wire input, the counter circuit counts for number of counts that has been set in advance with a binary switches. When the counting process is completed, a silicon controlled rectifier (SCR) is triggered, discharging the capacitor into an electric match for igniting an explosive charge. Oswald does not teach a digital counter circuit capable of being programmed remotely. Oswald also does not teach a method of restoring the circuit to an inert state after the capacitor has been charged. Rather, Oswald teaches a blasting circuit where actuation of the electric match appears to be inevitable after the capacitor has been charged.

U.S. Pat. No. 4,825,765, issued to Ochi et al., discloses a delay type electric detonating primer including a capacitor for storing electric charge and a clock pulse generating circuit having a crystal oscillator. A power source is supplied to a two-terminal input of the primer. Power from the power source is used to charge the capacitor. When power is removed from the two-terminal input, an actuation signal is produced that causes a counting circuit to start counting clock pulses from the clock pulse generating circuit. When the counting circuit counts to a value that has been set using binary switches, an ignition signal is generated. A switching circuit that includes an SCR then applies the charge in the capacitor to an igniting resistor, which ignites an explosive charge. Ochi et al. do not teach a digital counter circuit capable of being programmed remotely. Ochi et al. also do not teach a method of restoring the circuit to an inert state after the capacitor has been charged. Rather, Ochi et al. teach a blasting circuit where actuation of the electric match appears to be inevitable after the capacitor has been charged. Furthermore, Ochi et al. require an expensive crystal oscillator, which may be damaged or adversely and unpredictably affected by high acceleration. Thus, the blasting circuit of Ochi et al. is unsuitable for incorporation into projectiles.

U.S. Pat. No. 4,712,477, issued to Aikou et al., discloses an electronic delay detonator for igniting an ignition resistor. DC power from a blasting machine is connected to a two-wire input of the detonator. The DC power passes through a bridge rectifier and charges a power supply capacitor and the capacitor of an RC circuit. The RC circuit is connected to a comparator and provides a time delay after DC power is applied to the two-wire input of the detonator. After the time delay, the comparator changes state, causing a latch circuit to trigger a current switching circuit to apply current from the power supply capacitor to a detonator ignition resistor. The detonation ignition resistor ignites an explosive charge. Aikou et al. do not teach a fuze incorporating a digital timing circuit. Aikou et al. also do not teach a fuze where a capacitor can be charged before the time delay period begins. Furthermore, Aikou et al. do not teach a fuze that may be restored to an inert state after the power supply capacitor has been charged. Additionally, Aikou et al. do not teach a fuze where the timing period may be remotely programmed.

U.S. Pat. No. 4,233,673, issued to Cricchi et al., discloses an electrically resettable non-volatile memory for a fuse system. The memory has a plurality of storage bits, each bit comprising a insulated gate field effect transistor (IGFET). The IGFETs may be set one of two threshold voltage states to represent binary information. The binary information may be read back from the IGFETs. A fire command transfers the binary information to a counter. The counter is then operated at a predetermined clock rate until overflow occurs for generating a signal for detonating the explosive projectile. Cricchi et al. do not teach a fuze system where the projectile is coupled to the launcher by a 2-wire non-polarized connection, but rather Cricchi et al. teach a terminal box requiring four terminals, the orientation of which is inflexible. Furthermore, Cricchi et al. do not teach a method for providing frequency compensation for an oscillator in the projectile.

U.S. Pat. No. 4,424,745, issued to Magorian et al., discloses a digital timer fuze. When a pilot arms the system and selects a firing mode, power is supplied to each fuze in the load. When the firing button (pickle switch) is depressed, timing commands are injected into each fuze and the rocket motors are initiated. As each rocket moves forward under motor thrust, the lead to its fuze is separated. Physical interruption of this circuit initiates the "run" phase of the digital timer fuze. The digital time fuze is electrically connected to a fuze setter. A signal from the fuze setter charges a power supply capacitor and causes a counter to count clock pulses for a given period of time and store the count. When the umbilical line connecting the fuze to the fuze setter is severed, the main counter counts down at a given rate. When all of the stored counts have left the counter, the counter gates an SCR which allows the power supply capacitor to actuate the detonator. Magorian et al. do not teach a method for compensating the frequency of an oscillator in a projectile. Magorian et al. do not teach the initiation of a final counting sequence prior to launch or the confirmation of launch after some time period subsequent to the launch. Furthermore, Magorian et al. requires an discrete SCR firing circuit. Magorian et al. does not teach a firing circuit that can be formed in an integrated circuit (IC) along with oscillator and counter circuitry.

U.S. Pat. No. 4,421,030, issued to DeKoker, discloses an electronic safe and arm device for generating a trigger signal for initiating detonation of a flying plate detonator. A normally closed arm enable switch prevents the charging of the trigger capacitor until after break-wire launch has occurred. DeKoker does not teach the charging of a capacitor prior to launch. DeKoker detonates an explosive upon impact with a target. DeKoker does not teach the use of timer to ignite an explosive charge after a preset time.

U.S. Pat. No. 3,500,746, issued to Ambrosini, discloses an electronic time fuze mounted in a projectile is connected to ground equipment through an umbilical cord until the projectile is launched. The umbilical cord exchanges information between the fuze and the ground equipment so the fuze can more accurately measure the time elapsed from projectile launch to detonation. The fuze includes a local oscillator that is energized by the power stored in the capacitor. Output pulses from the local oscillator are coupled through a launch gate to a counter which is set prior to launch. After the projectile is launched, the local oscillator pulses count down the setting of the counter until a zero state is reached, at which time the detonator is actuated. Prior to launch, the counter is set, errors in the frequency of the local oscillator are compensated for, and the power supply capacitor is charged through the umbilical cord. The errors in the local oscillator frequency are compensated for either by modifying the initial setting of the Counter or correcting the frequency itself of the local oscillator. Ambrosini does not teach ignoring any signals present at the connecting wires of the projectile for a period of time at launch. Ambrosini does not teach the use of a two-wire non-polarized connection for providing power to the fuze and for transmitting signals to and receiving signals from the fuze.

U.S. Pat. No. 3,964,395, issued to Kaiser et al., discloses an electrical primer for projectiles in which the charge on a capacitor is stepwise reduced by periodic timing pulses to a level at which the projectile is armed. Kaiser et al. do not teach a method for setting a digital counter remotely. Kaiser et al. do not teach a method for remotely compensating for frequency inaccuracies of an RC oscillator in a projectile.

Furthermore, the above references are directed toward military ordnance. The present invention is useful for fireworks and pyrotechnic displays. It is generally not economical to apply devices intended for use in military ordnance to fireworks and pyrotechnic displays because such devices are generally complicated and expensive. Prior art devices providing communication to the fuze have required multiwire connections, typically involving four or more wires, where the order of the wires had to be maintained. Mismatching of the wires in prior art devices leads to failures, misfires and/or safety hazards. Also, such devices may be made of materials that could be harmful to spectators and others and to the environment. Moreover, there is nothing to suggest the combination of the above references or their application, either alone or in combination, to fireworks and pyrotechnic displays. Thus, a simple, inexpensive, safe and reliable time fuze applicable to fireworks and pyrotechnic displays is needed.

U.S. Pat. No. 3,068,756, issued to Schermuly, discloses a discharger for pyrotechnic devices that uses a conventional electrical igniter to ignite an explosive charge to eject a container from a casing. Schermuly does not disclose an electronic fuze to be ignited after a time delay after launch. Schermuly also does not teach the use of a digital timing circuit. Furthermore, Schermuly does not teach the use of an electrical energy storage means in the projectile.

Traditionally, fireworks have been simply constructed. A typical fireworks shell includes an initial fuze, an initial charge, a main fuze and a main charge. These fuzes and charges are chemical based. The initial fuze is ignited by a technician and allow the technician time to get away from the shell before the initial charge explodes. The initial fuze ignites the initial charge. The initial charge ignites the main fuze and propels the main charge into the sky. The main fuze provides a delay which allows the main charge to reach the desired burst location. After the delay, the main fuze ignites the main charge.

Prior art fireworks have not been as safe or reliable as desired. Once the initial fuze is ignited, the initial charge, the main fuze and the main charge are ignited in sequence with no way to interrupt the process. Also, chemical time delay fuzes have been somewhat inaccurate and unpredictable. Furthermore, it has not been possible to easily and quickly test the components of an assembled shell in an automated manner prior to launch.

SUMMARY OF THE INVENTION

The present invention provides an electronic time fuze for controlling and initiating the explosion of explosives. The present invention may be applied to fireworks and pyrotechnic displays. The present invention provides a safe, reliable and low cost method for providing precise timing and for providing timing when a projectile is propelled by a means other than a conventional pyrotechnic charge or exothermic chemical reaction.

The present invention provides energy transfer and bidirectional communication through a non-polarized two-wire interface. The present invention includes safety features not found in prior art devices. If a shell is removed from its launcher prior to launch, it is reset to an inert state, thereby making it safe. Also, if the shell fails to launch, it is .also reset to an inert state, making it safe. To provide these safety features, the present invention verifies the connection of the interface wires prior to launch, ignores any signals present on the interface wires during launch, and verifies the disconnection of the interface wires after launch. If the verification of the interface status fails at any time, the fuze is reset to an inert state substantially immediately.

The present invention involves a fuze that includes a electronic fuze control circuit, powered by a capacitor, that triggers a squib at the appropriate time to initiate an explosion. The electronic fuze control circuit is controlled by a local control unit (LCU) located near the launch apparatus for the projectile. The LCU transmits electrical energy through a non-polarized two wire interface to the fuze to charge the capacitor. Interfaces that are polarized or that have more than two wires may alternatively be used. When the capacitor is charged, it powers the electronic fuze control circuit. The LCU also sends signals to and receives signals from the fuze via the two wire interface. The LCU verifies proper operation of the fuze, compensates for inaccuracies in the internal clock of the fuze and loads the fuze with a timing value. The LCU also initiates a counting process that leads to an explosion unless a malfunction is detected.

The preferred embodiment of the present invention includes a fuze having an electronic fuze control circuit fabricated on an integrated circuit (IC). The IC is mounted on a printed circuit board (PCB). An energy storage capacitor, a squib and the non-polarized two wire interface are also connected to the PCB.

The fuze is normally maintained in an inert state, where the energy storage capacitor is discharged and any semiconductors are maintained in an off, non-conducting, or zero state. When the projectile containing the fuze has been loaded into its launching apparatus, an LCU associated with the launching apparatus applies power across the two wire interface. The electronic fuze control circuit uses the power from the interface to charge the energy storage capacitor. The energy storage capacitor is preferably a electrolytic capacitor, although other types of capacitors capable of storing substantial amounts of energy, for example tantalum capacitors, may alternatively be used.

When the energy storage capacitor is charged, the IC reaches a powered up state. The IC incorporates power on reset circuitry to ensure that the IC powers up in a known, safe state. The LCU sends a wake up signal to the IC. The IC responds by sending a fixed number of clock pulses to the LCU. The LCU analyzes the clock pulses to ensure the fuze is operating properly and computes a compensated timing value to compensate for any inaccuracy of the IC internal clock. The LCU then transmits the compensated timing value to the IC. The IC responds with a verification to ensure accurate transfer of the compensated timing value to the IC. The IC then waits for an initiation signal. When the LCU sends the initiation signal, the IC ignores any further inputs for a fixed period of time. The IC begins a counting process that, upon completion, leads to an explosion. Therefore, the present invention provides a safe, reliable, low cost method to control and initiate an explosion. Thus, the disadvantages of the prior art have been overcome.

BRIEF DESCRIPTION OF THE DRAWINGS

FIGS. 2, 2(A), 2(B), 2(C), 2(D), 2(E), 2(F), 2(G), 2(H), and 2(I) are diagrams of a portion of the IC of the preferred embodiment of the present invention.

FIGS. 3, 3(A), 3(B), 3(C), 3(D), 3(E), and 3(F) are diagrams of a portion of the IC of the preferred embodiment of the present invention.

DETAILED DESCRIPTION OF THE INVENTION

Figure 1:
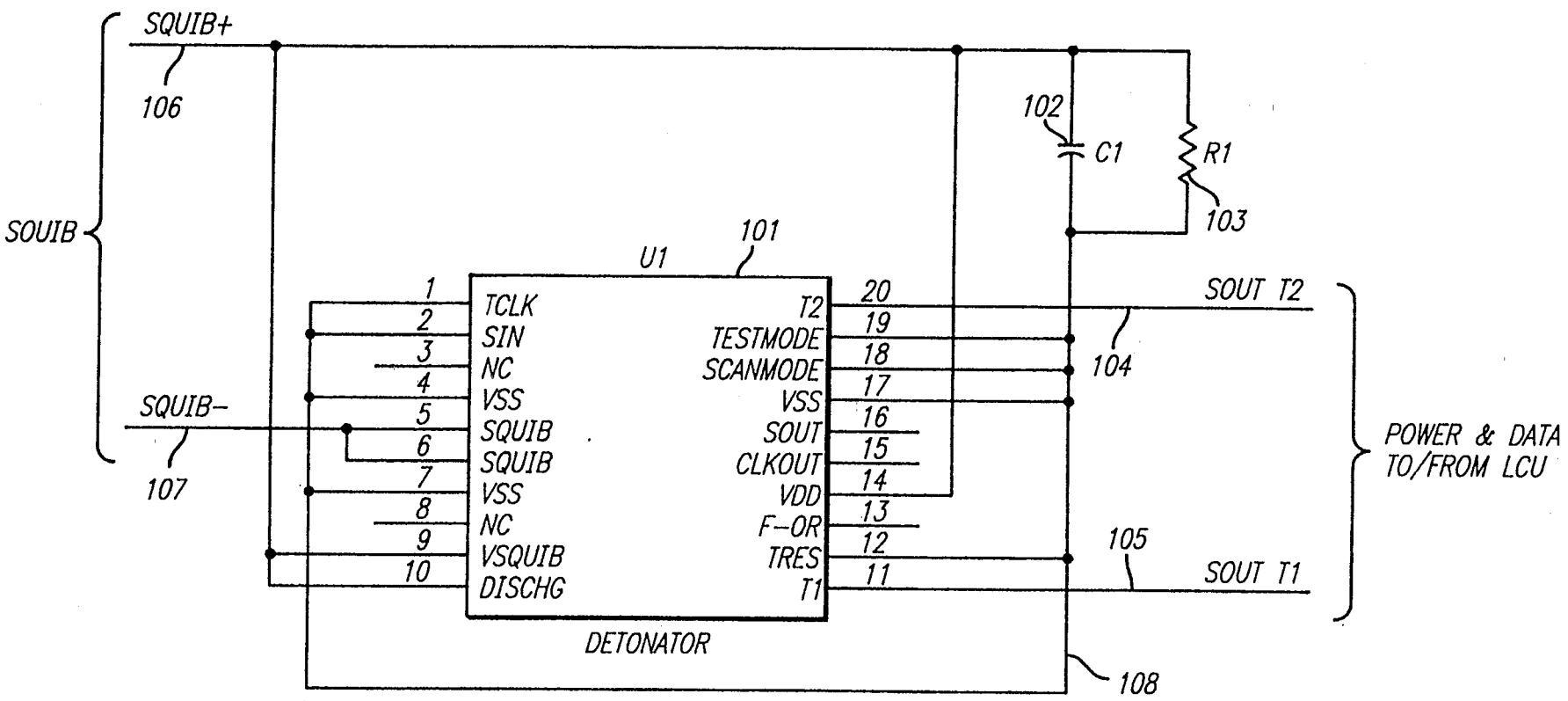
FIG. 1 is a schematic diagram of the preferred embodiment of the present invention.
Figure 2A:
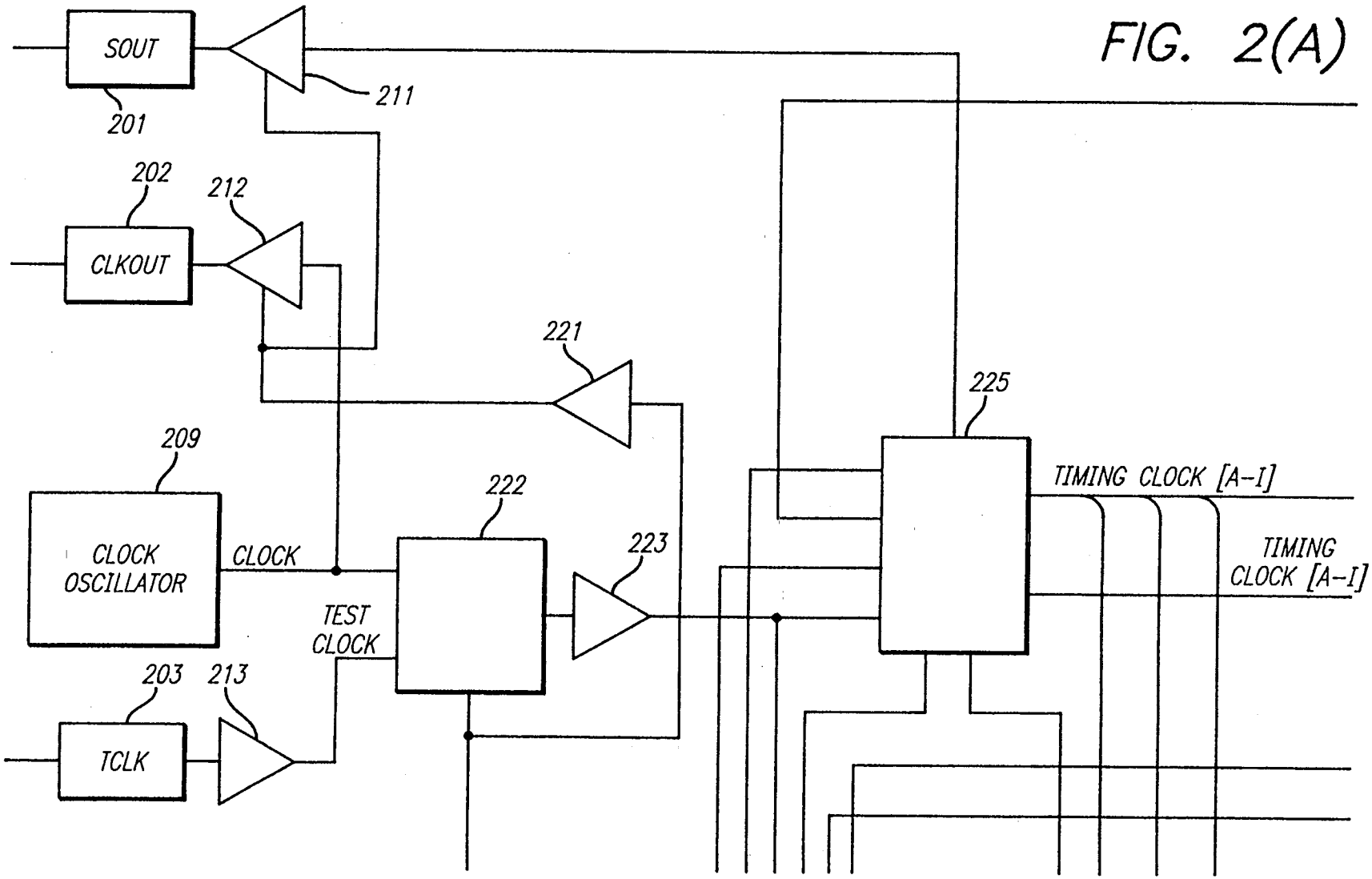
Figure 2B:
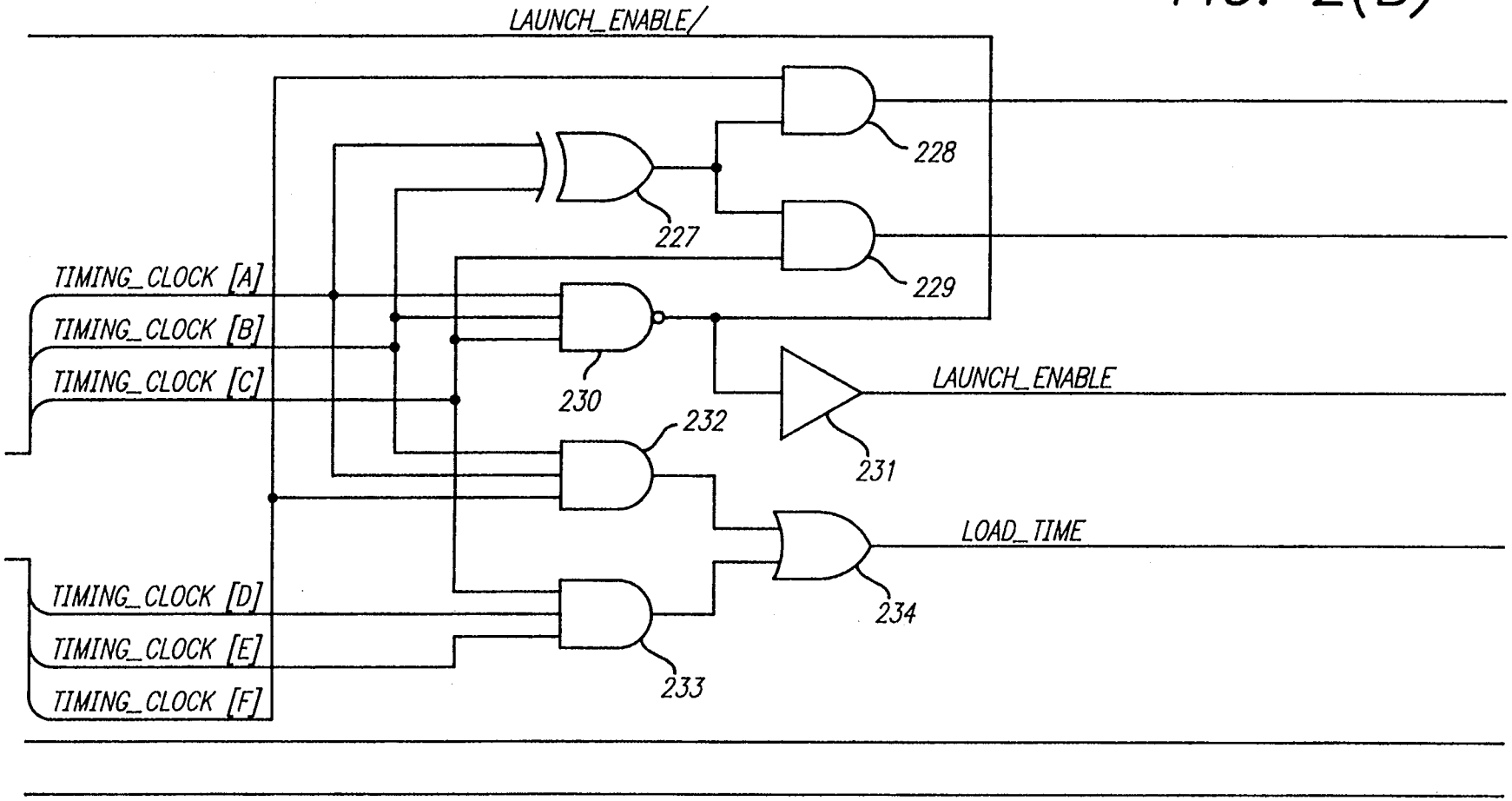
Figure 2C:
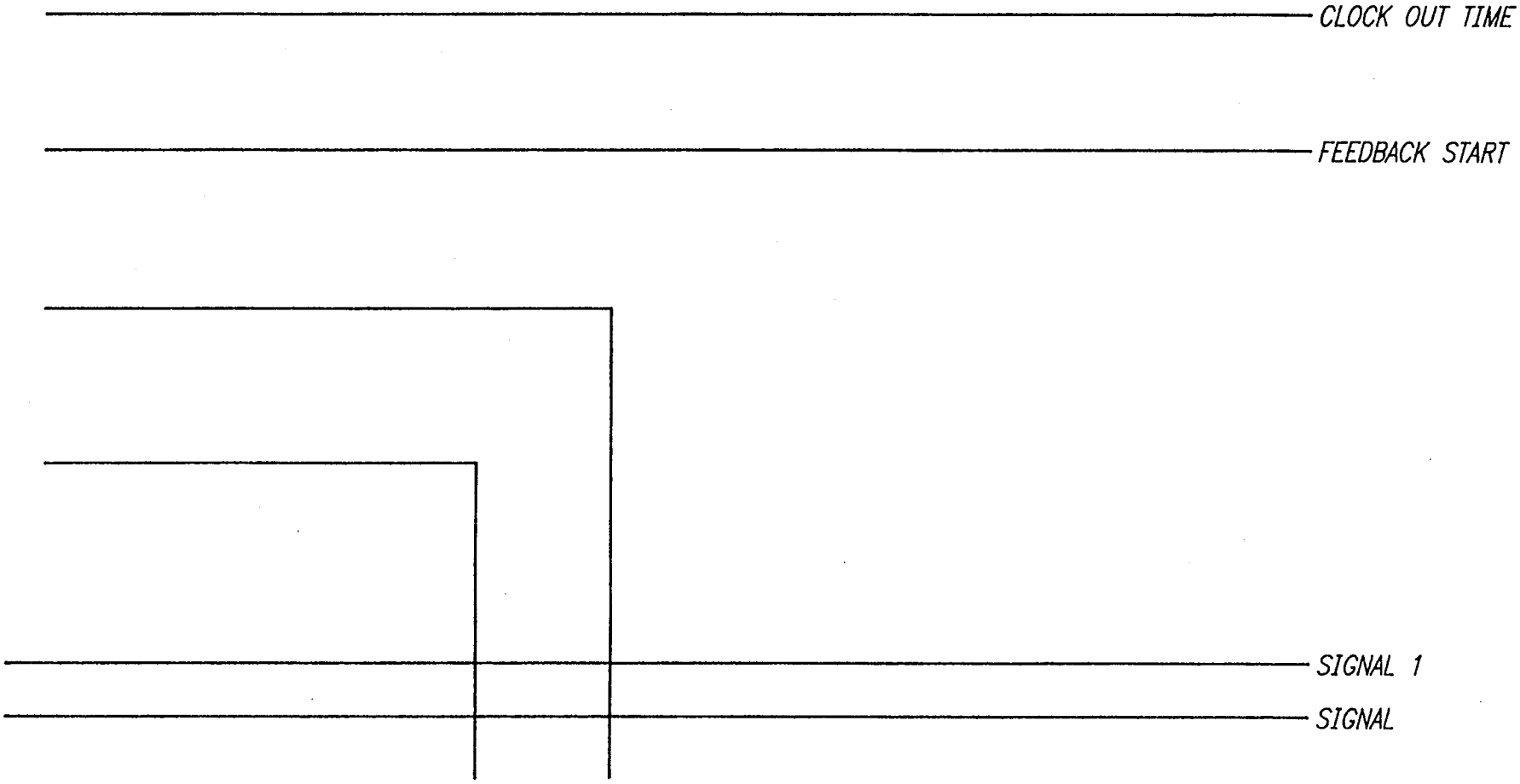
Figure 2D:
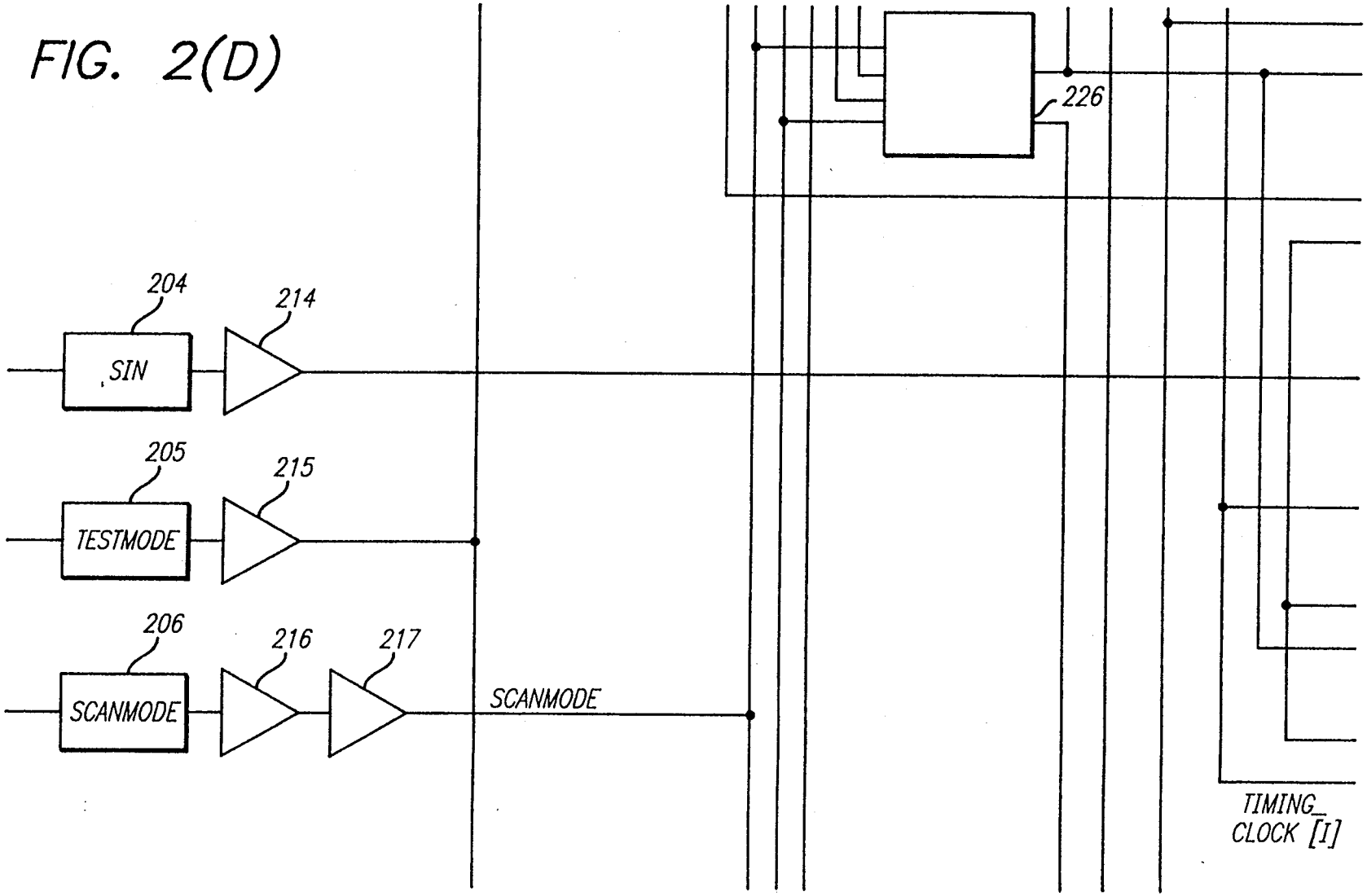
Figure 2E:
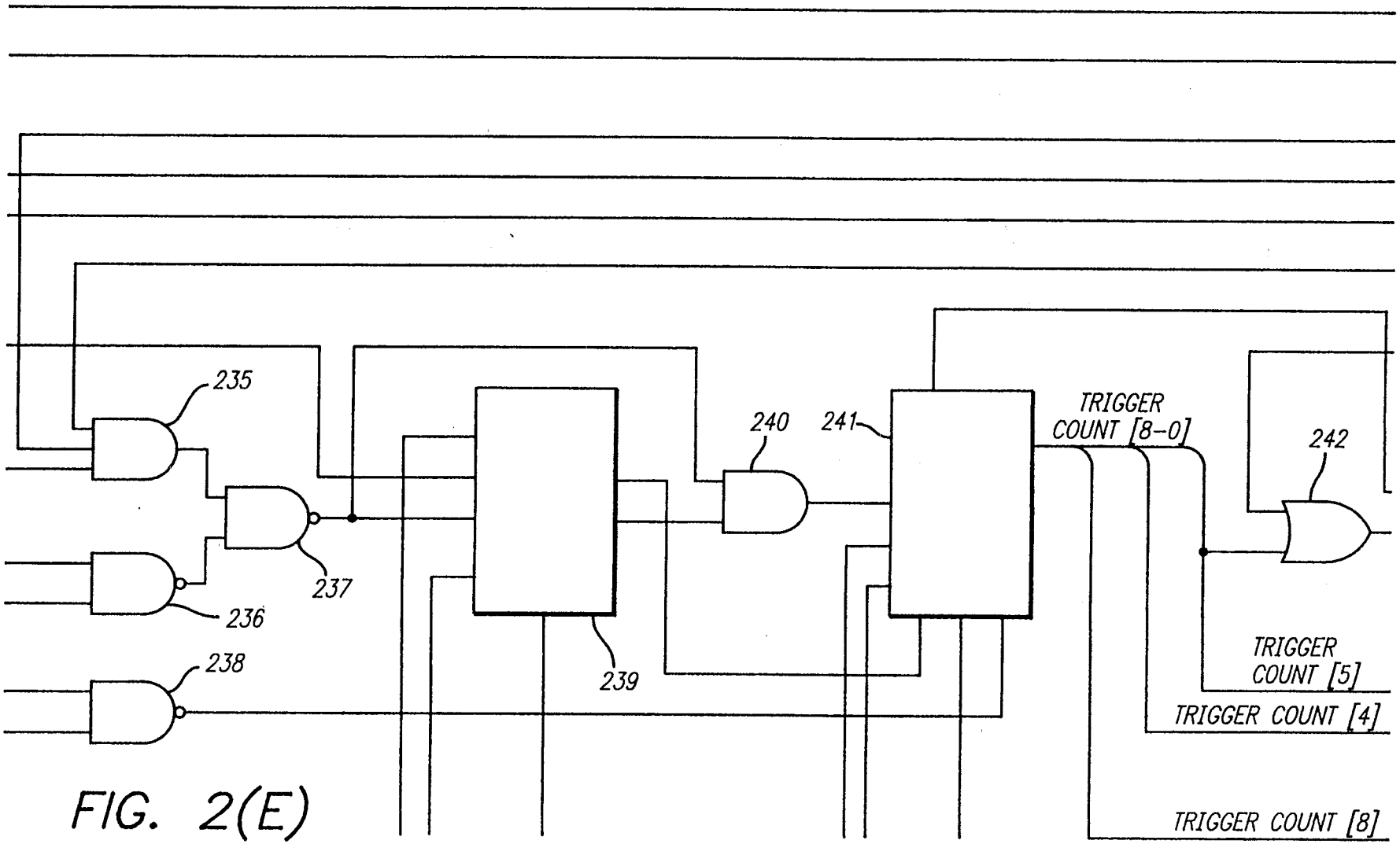
Figure 2F:
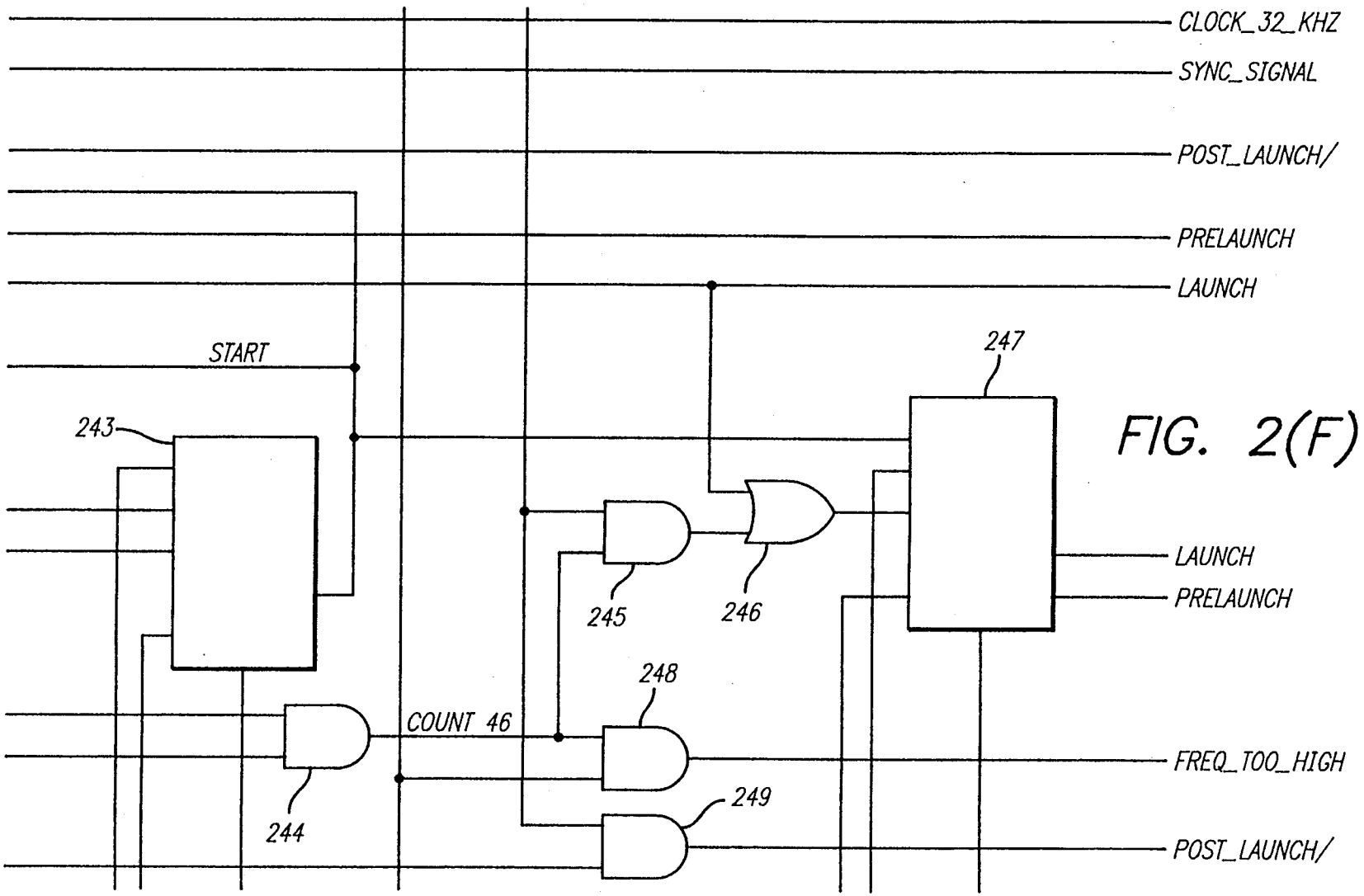
Figure 2G:
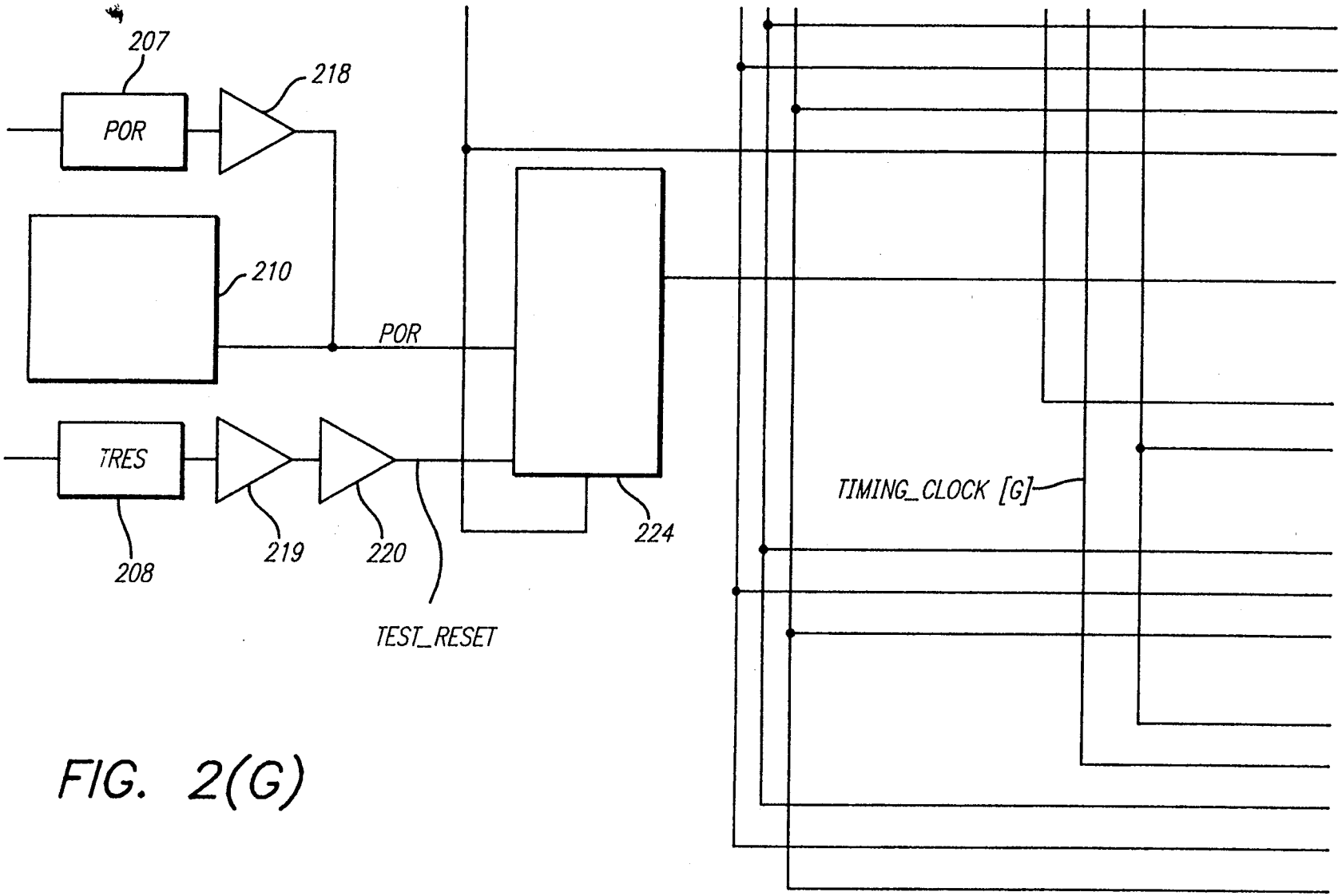
Figure 2H:
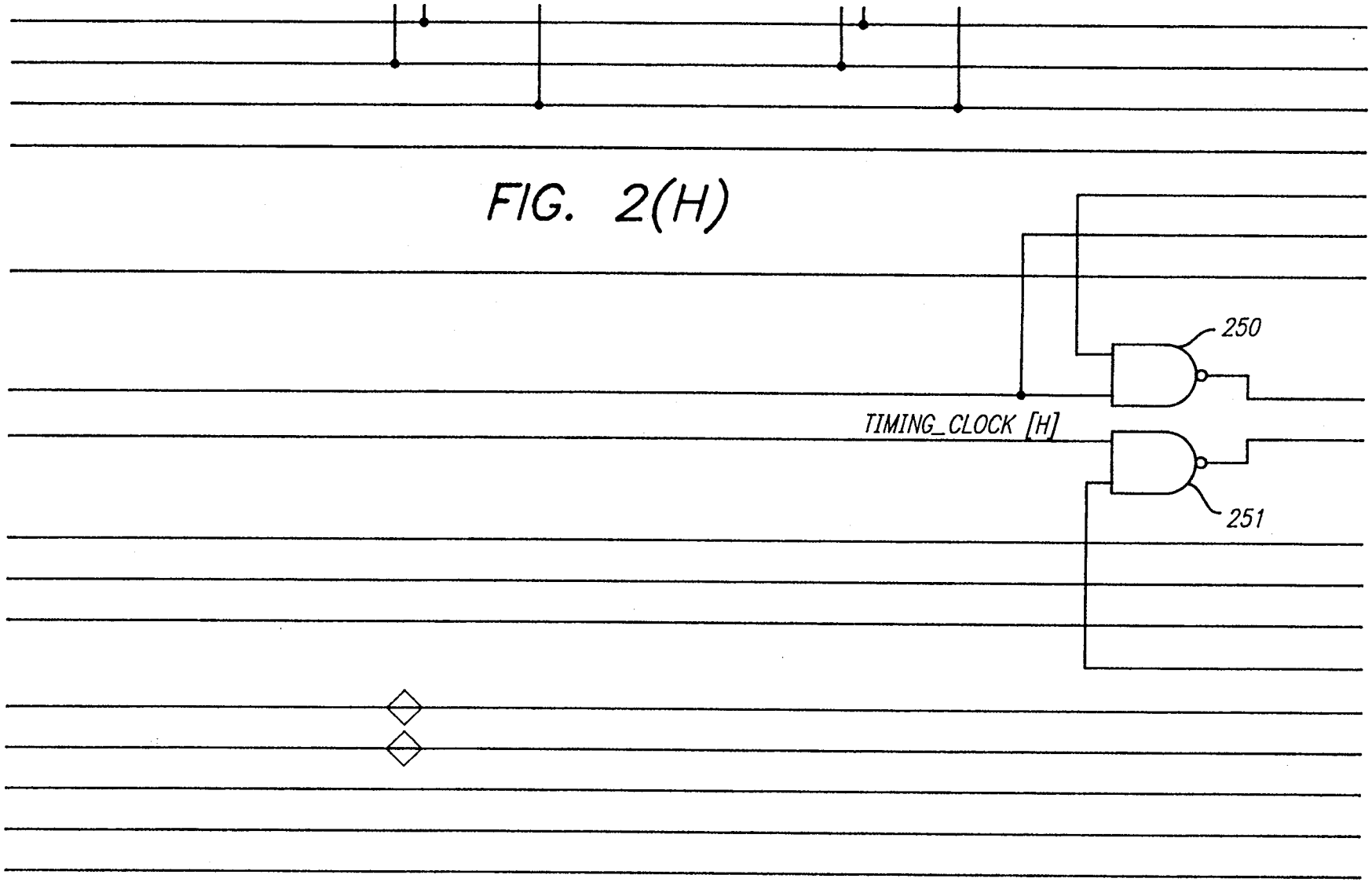
Figure 2:
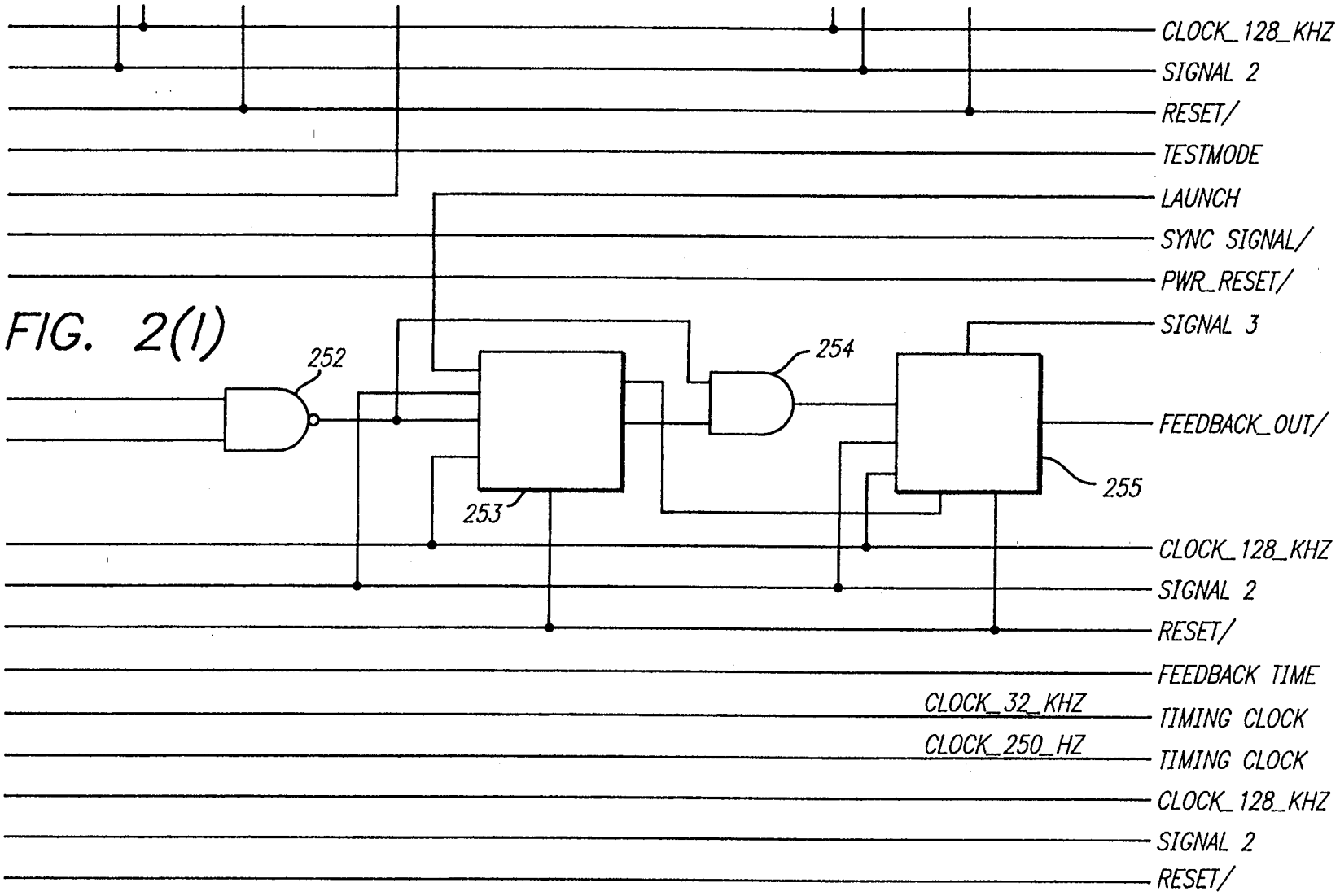

An electronic time fuze for controlling and initiating the explosion of explosives is described. In the following description, numerous specific details, such as specific frequencies, times and counts, are set forth in order to provide a more thorough understanding of the present invention. It will be apparent, however, to one skilled in the art, that the present invention may be practiced without these specific details. In other instances, well-known features have not been described in detail in order not to unnecessarily obscure the present invention.

The preferred embodiment of the present invention includes a fireworks detonator integrated circuit (IC) containing the control logic and power switching devices needed to ignite a standard fireworks squib after a precise time delay (4 millisecond resolution). The present invention provides advantages over and may be used as an inexpensive replacement for the relatively inaccurate chemical time delay fuses currently used in fireworks shells. The large scale integration of the IC enables its use with a minimum of external components; the complete circuit placed in a shell requires only the IC, a squib, and a capacitor. The circuit components are mounted on a small printed circuit board which is placed inside the fireworks shell and is launched with the shell. Power, detonator time delay programming, and start of the delay timer are supplied by a microprocessor based local control unit (LCU) which is mounted near the fireworks mortar tube. An LCU similar to the type described in U.S. patent application Ser. No. 07/817,591, filed Jan. 7, 1992, which is incorporated herein by reference, may be used with the present invention. The detonator IC requires a specific sequence of control signals from the LCU and provides verification signals back to the LCU before it starts the countdown timer and ignites the squib. The control signal sequence prevents inadvertent operation of the detonator after application of random signals or voltages on the detonator inputs. The verification signals provide the LCU with the condition of the detonator, so the LCU can make timing corrections or report a failed detonator to an operator. If the fireworks shell does not leave the mortar tube at launch time and subsequently break its input wire connections, the detonator can sense this and force a reset to prevent the shell from detonating in the tube.

Shortly before the scheduled launch of a shell, the LCU applies power to the detonator through two wires. Polarity of the two wires is not important. The non-polarized interface of the present invention increases safety and reliability and reduced costs. Since the wires cannot be connected backwards, misfires and failures are avoided, increasing safety and reliability. Since pigtail leads or simple and inexpensive non-polarized connectors may be used rather than polarized connectors, costs are reduced. Direct current (DC) from the LCU will charge the detonator capacitor to store energy used during the shell's flight and for squib ignition. After waiting for the capacitor to charge and the IC's internal clock to stabilize, the LCU sends a Start command to begin the programming and verification communications. The detonator responds by sending a fixed number of pulses at one fourth of its clock frequency. The LCU uses the clock pulses to determine that the detonator is functional within normal parameters, and to correct LCU output for accurate detonator timing. To load the time delay, the LCU then sends a number of pulses to the detonator for a fixed time. The detonator responds by sending a corresponding number of pulses to the LCU. Knowing the clock frequency and the number of time delay pulses, the LCU has an accurate feedback of the detonator's programmed time delay. At this point, the detonator is programmed and waiting for launch. If at any time prior to the Launch command being issued the projectile is removed from the launcher, the fuze is reset to an inert state and made safe. Thus, one may pull a shell from its launcher without risk of explosion. Just before the fireworks shell is launched from the tube, the LCU sends the Launch command to the detonator to start the ignition timer. The LCU immediately launches the shell, causing the two wire connections to break. The detonator waits a fixed time of approximately 400 milliseconds, and checks the status of its inputs. If the detonator senses voltage, it assumes the shell is still in the tube connected to the LCU and resets. Reset will prevent the shell from exploding in the tube, and allow the detonator to be reused. If the detonator senses no input, it assumes a successful launch and continues timing until detonation. At detonation, output transistors in the IC switch current from a capacitor through the squib, heating the squib element and igniting its powder charge.

A more detailed description of the programming and operation of the circuit follows.

Upon power-up, the circuit goes into reset mode and remains there until communication is received from the Local Control Unit (LCU).

After giving the circuit time to stabilize, the LCU sends out a signal at approximately 50 kHz for 3 milliseconds. When the detonator identifies this signal it latches on the Start bit enabling the high order bits of the Timing Generator (see FIG. 1).

Approximately 125 milliseconds after Start goes true, Clock_*Out*_Time is enabled while the detonator outputs 8,192 pulses at one fourth of its primary clock frequency (the design primary frequency is 128 kHz so this time period is nominally 250 milliseconds) The LCU watches these pulses to verify that the detonator is functional, and to measure the exact frequency of the clock (this eliminates the need for precision external oscillator resistors and capacitors). The LCU uses the actual clock frequency as a correction factor in determining the initial count to load into the detonator for the delay time and how long each of the timing windows will be open. The LCU may measure the fuze clock by measuring its frequency directly or, preferably, by measuring the duration of the clock pulses, since the period and frequency have an inverse relationship. The period of the fuze clock pulses may be measured in units of the period of a clock signal of the LCU.

Immediately following the Clock_Out_Time period is a nominal 250 millisecond period (Load_Time) during which the LCU outputs the initial count needed to give the desired time delay between launch and detonation. The LCU does this by calculating the precise frequency that will allow it to output the exact number of pulses in the given period. The equation used is:

$$\text{Load Count} = \frac{\text{Time Delay in milliseconds}}{1000} * \frac{256\ \text{Pulses}}{\text{Second}} * \frac{256\ \text{milliseconds}}{\text{Measured Time}}$$

where the measured time is the amount of time measured by the LCU when the fuze transmitted a pulse train of 8192 pulses at one quarter of the frequency of its internal R/C clock. Since the internal R/C clock of the fuze has a nominal frequency of 128 kHz, one quarter of that frequency is nominally 32 kHz, but may vary due to imprecision of the resistor and capacitor used in the internal R/C clock.

The pulses are fed into the feedback counter.

At the completion of Load_Time the Feedback_Start period goes true for a nominal 250 milliseconds. The rising edge of Feedback_Start latches the Feedback_Time bit which enables the detonator to output a 32 kHz signal. When the sum of the pulses received from the LCU and the feedback pulses equal 8,192, Load_Time clears causing the chip to cease transmitting. While the feedback pulses are being output they are simultaneously loaded into the Detonation Timer to provide the preset for the detonation delay. Therefore, the number of feedback pulses is "8192-Load_Count". Since the detonation timer is loaded with a value of 8192-Load_Count, the detonation timer will, when caused to begin counting, count up until it reaches 8192, so as to count the loaded number of pulses before detonation.

Immediately following the Feedback_Start period, the Launch_Enable signal goes true indicating that the detonator is fully armed and ready for launch. The LCU maintains a high level on the input pin to keep the detonator from resetting until it is time to launch. Immediately prior to launch the LCU outputs a signal between 48 kHz and 64 kHz for two milliseconds. This is the launch command. Upon receipt of the launch command the detonator begins timing and masks its inputs for 416 milliseconds. This masking is done so that any electrical noise generated by the launch does not cause a response by the circuit. Upon unmasking the inputs, if the connection with the LCU is intact, the detonator concludes that the shell did not launch and resets itself to its power-up state rendering the shell inert. If communication is not possible, it concludes the launch went as planned and continues counting the time delay toward explosion. When the sum of the counter value initially loaded into the detonation timer plus the pulses counted since launch equals 8,192, power is provided to the squib causing it to ignite and set off the pyrotechnic device in the shell.

Below is a description of the detailed operation of each of the functional blocks shown in the block diagram (FIG. 1).

The interface to the LCU is designed so that the leads can be connected with no regard to polarity. It is a bi-directional interface that is also used to provide power to VDD and Vsquib. The non-polarized nature of the interface increases the safety and reliability of the fuze and reduces its cost. Since the two-wire interface may be connected in either orientation of the two wires, errors in the connection of the wires are prevented. Thus, failures, misfires, accidents and other problems relating to misconnection of the wires are avoided, increasing safety and reliability. Simple wires, pigtail leads or non-polarized connectors may be used, avoiding the need for and expense of polarized connectors. Thus, the present invention provides an inexpensive means of connection.

Both pin T1 and T2 have large anti-static diodes connecting them to VDD and Vss. When a differential voltage is applied across these pins, the external capacitor connected from VDD to VSS will be charged since each pin has a diode to Vss and a diode to VDD, the four diodes act as a full-wave bridge with VDD as the +output and Vss as the −output. Likewise parallel pads are connected to T1 and T2 with isolation diodes connected between Vsquib and Vss. The external capacitor connected between these points is also charged upon application of power to T1 and T2.

The input signals coming from T1 and T2 feed into an XOR gate. Whenever the voltage is the same on the two pins a logic zero is seen on Sync_Signal. When the two pins do not contain the same voltage level, a logic one is on Sync_Signal. This enables the detonator IC to read data regardless of the polarity of T1 and T2.

The clock is a free running 128 kHz RC controlled square wave oscillator. It does not use precision trimmed resistors, so its frequency may vary somewhat from the nominal frequency. This variation is accommodated by the control software in the Local Control Unit. The clock runs continuously while power is applied to the IC.

The Start/Launch Detector provides signals to other portions of the circuit that are used to determine the current phase of the programming and operation sequence. The signals provided by the State Machine are:

Start
Pre-Launch
Launch
Post Launch
Freq Too High

Each of these signals is described separately below.

Start is used by the Timing Generator as a master enable.

The Start signal is logic zero on Power-up and remains so as long as the circuit is being reset. When the circuit receives a minimum of a 32 kHz input from the LCU for at least 1 millisecond, Start is latched to a logic one. Start remains set throughout the programming and operation of the timer unless a reset occurs.

Pre-Launch is used by the Reset Detect circuit to identify which set of reset criteria should be used.

Pre-Launch is true when the circuit is powered up or reset. It remains true until a launch command is received (48 kHz to 64 kHz input on Signal from the LCU for at least two milliseconds) while Launch_Enable is true. Pre-Launch remains false through the remainder of the timing operation unless a reset occurs.

Launch is used by the Detonation Timer as an enable to begin timing the detonation delay.

Launch is the inverse of the Pre-Launch signal. It is false on power up and reset. It remains false until a launch command is received (48 kHz to 64 kHz input on Signal from the LCU for at least 2 milliseconds) while Launch_Enable is true. Launch remains true through the remainder of the timing operation unless a reset occurs.

Post Launch is used by the Reset Detect circuit to blind the inputs immediately following launch and to determine which reset criteria to use thereafter. It is also used by the Detonation Timer to disable the igniter until the shell is well clear of the barrel.

Post Launch is false on power up and reset. It remains false until 416 milliseconds after Launch goes true. During the period between Launch going true and Post Launch going true the inputs are masked and the detonation output is disabled. Post Launch remains true through the remainder of the timing operation unless a reset occurs.

Freq_Too_High is generated during Load_Time. If the frequency being received from the LCU is greater than 48 kHz, this signal goes true. Freq_Too_High will cause the Reset circuit to generate a Reset pulse. The Freq_Too_High signal provides an additional safety feature. Since the wake-up command uses a low frequency signal and the fire command uses a high frequency signal, it is important to detect an excessive frequency being applied at a time when a wake-up command is expected so as to prevent misinterpretation of the signal as a fire command and inadvertent detonation. If a signal that might be interpreted as a fire command is detected, the Freq_Too_High signal cause a reset, rendering the fuze inert and ensuring safety by preventing explosion.

The Reset Detect Circuit has four distinct and different operating phases. They are:

Power Up Reset
Pre-Launch
Launch
Post Launch

Each will be described separately below.

During the power up sequence all counters and flip flops will be held in a reset state. In addition all outputs shall be maintained in a high impedance non-conducting state. This reset condition shall persist until the power supply voltage level has reached a sufficiently high level for all logic elements to function reliably.

During the time prior to a Launch command being detected and after power has stabilized, the circuit generates an 8 millisecond reset pulse every 16 milliseconds if a connection with a Local Control Unit (LCU) is not detected (i.e.: Signal is low).

If Freq_Too_High goes true during the Load_Time period, a reset pulse will be generated for 8 microseconds.

For 416 milliseconds following the receipt of a valid Launch command from the Local Control Unit (LCU), system resets are disabled. Ignition of the squib is also disabled during this 416 millisecond period. This feature ensures the shell will reach a safe distance clear of the launcher before exploding, even if the detonation timer were set to a value less than 416 milliseconds. Thus, an important safety feature is provided.

Operation of the Reset circuit during the period commencing 416 milliseconds after launch and lasting until detonation, is exactly opposite of the logic used during the pre-launch period. If no connection is detected with the Local Control Unit, reset is inhibited. If Signal is seen high for a total of 8 milliseconds, then a reset pulse is generated.

This logic is implemented to inhibit detonation if the shell did not launch properly when the launch command was given.

The Timing Generator contains a 17 bit counter and some random logic to provide the timing cues for the various circuits within the detonator. The counter is designed such that the low order nine bits count continuously unless reset is true. The high order eight bits only count if Start is true and Launch_Enable is false.

Seven outputs are provided based on four inputs. The Outputs provided are:

Timing_Clock[1] alias Clock_32_kHz
Timing_Clock[7] alias Clock___500_Hz
Timing_Clock[8] alias Clock_250_Hz
Clock Out Time
Load Time
Feedback Start Launch Enable Each is described separately below.

Timing_Clock[I] (32_kHz_Clock) is output to the LCU during Clock_Out_Time and Feedback_Time. It is used by the Feedback_Timer and the Detonation Timer as a data pulse during Feedback_Time. This signal is active whenever a reset pulse is not active.

Timing_Clock[7] (Clock_500_Hz) is used by the Start/Launch Detector to provide 1 millisecond windows during the Pre launch time to look for Start, Launch, and Freq_Too_High conditions. Once a valid Launch command is received, this signal is ignored. This signal is active whenever a reset pulse is not active.

Timing_Clock[8] (Clock_250_Hz) is used by the Detonation Timer when Launch is true to provide the timing pulses for the countdown to ignition. This signal is active whenever a reset pulse is not active.

The upper bits of the counter are used along with discrete logic to generate a sequence of timing windows for the programming of the detonator. The first of these windows is Clock Out Time. 125 milliseconds after Start transitions true Clock Out Time goes true. This signal is used to enable the 3-state output driver so that the Timing_Clock[l] can be fed to the Local Control Unit for verification that the detonator is alive and to measure the actual frequency of the clock.

Load Time is true during the 250 millisecond period following Clock Out Time. This signal is used to enable the Feedback Counter to receive the preset timing count from the LCU.

Feedback Start is true during the 250 millisecond period following Load Time. It provides an enable to the Feedback Counter to permit it to begin outputting pulses to the LCU and the Detonation Timer. The Feedback Counter does not use the entire Feedback Start period for this process. The Gated 32 kHz clock is used to provide the number of pulses required to bring the total of the preset pulses received plus the feedback output pulses to 8,192. When this number is reached, the Feedback Counter disables itself.

When the Feedback Start period expires, Launch Enable transitions true. This signal remains true until a reset occurs. It is used to enable the Start/Launch Detector to recognize a Launch command received from the LCU.

The Feedback Counter receives the timing count from the LCU, feeds it back as verification that the correct time was received, and loads the timing count into the Detonation Timer. The Feedback Counter consists of a 14 bit synchronous counter, a rising edge detector, a D Flip-flop, and some other logic.

During Load Time, the LCU transmits the precise number of pulses required for a 256 Hz clock (plus or minus the measured variation from nominal) to generate the desired detonation time delay. This count is loaded into the Feedback Counter. When Feedback Start transitions true the Feedback Counter begins outputting pulses back to the LCU until the most significant bit of the counter transitions high. This occurs when the total number of pulses into the Feedback Counter (pulses received from the LCU plus the Feedback Pulses) equals 8,192. The Feedback Counter disables itself at this point and is not used again.

Simultaneously with the pulses being fed back to the LCU, they are loaded into the Detonation Timer. Therefore, the Detonation Timer winds up loaded with 8,192 minus the original number of pulses sent by the LCU.

The Detonation Timer is the portion of the circuit actually used to provide the time delay and ignition current to the squib. It consists of a 14 bit counter, a rising edge detector, several output drivers and some other logic.

The counter is preloaded when Feedback Time is true. Feedback Time is used as an enable to allow Timing_Clock[1] to be clocked into the counter. The number of pulses loaded into this counter is equal to 8,192 minus the pulses originally loaded into the Feedback Counter by the LCU. When this is accomplished, Feedback Time transitions false.

The Detonation Timer remains idle until Launch transitions true. Launch is used as an enable to clock Timing_Clock[8] into the detonation counter. The counter will count until the most significant bit of the counter goes true. If Post Launch is true when this occurs, the squib drivers will be enabled and power will flow from the Squib power source through the squib and to ground. A reset occurring any time during the sequence will cause the counter to be reset and will disable the output drivers.

The input/output pin assignments and the signals associated therewith are described below.

| Signal Name | Function | Type |
|---|---|---|
| TCLK | Test Clock (Test Mode Only) | Input |
| SIN | Serial Data In (Scan Mode Only) | Input |
| Not Used | | |
| Vss | Circuit Gnd | Circuit Gnd |
| SQUIB | Squib Power Sink | Output |
| SQUIB | Squib Power Sink | output |
| Vss | Circuit Gnd | Circuit Gnd |
| Not Used | | |
| $V_{SQUIB}$ | Squib Power | Power Input |
| DISCHG | Discharge Vsquib on Reset | output |
| TI | LCU Programming Interface | Input/Output |
| TRES | Test Reset (Test Mode Only) | Input |
| Not Used | | |
| $V_{DD}$ | Circuit Power | Power Input |
| CLKOUT | Clock Out (Test Mode Only) | Output |
| SOUT | Serial Data Out (Scan Mode only) | Output |
| Vss | Circuit Gnd | Circuit Gnd |
| SCANMODE | Scan Mode Control Pin | Input |
| TESTMODE | Test Mode Control Pin | Input |
| T2 | LCU Programming Interface | Input/Output |

| | |
|---|---|
| CLKOUT | Output pin for measuring and assuring the operation of the internal oscillator. This pin is only active during Test Mode. |
| DISCHG | Discharge-Output pin used to discharge the Squib capacitor when a Reset occurs. |
| SCANMODE | Input pin used to put the chip into the Set/Scan mode. A logic 1 on this pin enable Scan Mode. A logic 0 disables Scan Mode. This signal is used during original manufacture testing only. It should be tied to Vss during normal operation. |
| SIN | Serial In-Input used to scan in a serial bit stream during Scan Mode. This signal is used during original manufacture testing only. It should be tide to Vss during normal operation. |
| SOUT | Serial Out-Output used to read the serial bit stream during Scan Mode. This signal is used during original manufacture testing only. |
| SQUIB | Squib-High current sinking output drivers used to fire the squib on detonation. |
| T1 | Data/Power Pin 1-One of two pins used to connect to the LCU before launch. Polarity of the connection does not matter. Both power and data are provided to the device via these pins. |
| T2 | Data/Power Pin 2-One of two pins used to connect to the LCU before launch. Polarity of the connection does not matter. Both power and data are provided to the device via |

-continued

| | |
|---|---|
| | these pins. |
| TCLK | Test Clock-Input pin used to feed a high frequency test clock into the device during original manufacture testing only. This signal should be tied to VSS during normal operation. |
| TESTMODE | Test Mode-Control input used to put the device into test mode for original manufacture testing only. A logic 1 causes the device to enter Test Mode. A logic 0 causes the device to enter Normal Mode. This signal must be tied to VSS during normal operation. |
| TRES | Test Reset-Input signal to externally reset the device. This signal is only active during Test Mode. A logic 1 will cause a chip reset to occur. A logic 0 allows the chip to operate. This signal should be tied to VSS during normal operation. |
| $V_{DD}$ | Logic Power Capacitor+ (Normally connected to $V_{SQUIB}$) |
| $V_{SQUIB}$ | Squib Power Capacitor+ (Normally connected to $V_{DD}$) |
| $V_{SS}$ | Logic and Squib Common |

The chip should be designed so as to power-up in a reset state even though $V_{DD}$ rise slowly as the capacitor charges. All outputs should be in a high impedance non-conducting state on power-up. All counters, latches, flip-flops, shift registers, and the oscillator should be held reset until $V_{DD}$ is within specified limits and is stable.

The Squib outputs should preferably be capable of sinking a total of at least 2 amperes. Minimizing the output resistance and/or voltage drop across the output devices is highly desirable. It is acceptable to add extra output pads to improve the output resistance and/or voltage drop. Multiple bonding wires may be used in parallel to decrease the voltage drop between the IC die and the IC package. Multiple drivers may be used in parallel to increase the current sinking capability. It is permissible for the device to sustain permanent damage after delivering this current pulse for a minimum of preferably 8 milliseconds.

In the preferred embodiment of the present invention, the IC should be constructed so as to ensure proper operation when $V_{DD}$ is within a range from 4.5 volts to 6.5 volts.

The T1 and T2 pins should preferably be capable of operating at two diode drops (1.2 volts) above $V_{DD}$.

Normal operating mode for this chip is to provide power through the T1 and T2 inputs at 7.5 volts from a current limited supply (maximum supply current is 35 milliamperes) through the electrostatic discharge (ESD) protection diodes to capacitor connected from GND to the $V_{DD}$ and $V_{SQUIB}$ pins. The capacitor preferably has a value of 1000 microfarads. When the shell is launched, the circuit is disconnected from the power supply and continues to operate off of the stored charge on the capacitor.

During normal operation prior to application of current to the squib, the IC preferably draws no more than 50 micro amps from $V_{DD}$.

During all modes of operation the maximum leakage current through the combination of the two SQUIB pins and the DISCHG pin should preferably be limited so as not exceed 30 milliamperes under any operating voltage or temperature condition specified herein.

The clock signal is generated by an internal R/C oscillator circuit. The clock frequency is preferably 128 kHz at 25° C. with $V_{DD}$ at 5.0 volts.

Although the present invention may be practiced with various clock frequencies, certain limits are preferred. Across the entire operating voltage and temperature ranges specified herein the absolute limits on clock frequency are preferably $F_{min}=100$ kHz and $F_{max}=150$ kHz.

Since the apparatus of the present invention is subjected to high acceleration forces when a shell is launched, the present invention should be constructed so as to provide high immunity to damage resulting from acceleration. The fuze should preferably be able to operate through an acceleration event of at least 780 G's on any axis for a duration of 20 milliseconds without damage and without being forced into reset.

Although the present invention may be practiced under various environmental conditions, it is preferable to construct the present invention so as to ensure its reliability over certain temperature and humidity conditions. It is preferable to provide a temperature range of −40° C. to 100° C. and relative humidity range of 30% to 100% during storage and non-operation. It is preferable to provide a temperature range of −18° C. to 60° C. and a relative humidity range of 30% to 100% during operation.

FIG. 1 illustrate a schematic diagram of the preferred embodiment of the present invention. IC 101 includes pins TCLK, SIN, NC, VSS, SQUIB, VSQUIB, DISCHG, T1, TRES, POR, VDD, CLKOUT, SOUT, SCANMODE, TESTMODE and T2. Pin TCLK is a test clock input. Pin SIN is a scan input. Pins NC are not connected. Pins VSS are the more negative power supply pins. Pins SQUIB are coupled to the more negative terminal of the squib through conductor 107. Pin VSQUIB is connected to the more positive terminal of the squib through conductor 106. Pin DISCHG is used to discharge energy storage capacitor 102 to restore the fuze to an inert state. Pin T1 is coupled to wire 105 of the two wire interface. Pin TRES is a test reset input. Pin POR is a power on reset output. Pin VDD is the more positive power supply pin. Pin CLKOUT is a clock output. Pin SOUT is a scan output. Pin SCANMODE enables or disables the scan mode. Pin TESTMODE enables or disables the test mode. Pin T2 is coupled to wire 104 of the two wire interface.

The two wire interface to the LCU includes wires 104 and 105. The more positive terminal of energy storage capacitor 102 is coupled to the first terminal of resistor 103, to the more positive terminal of the squib and to pins VSQUIB, DISCHG and VDD of IC 101. The more negative terminal of energy storage capacitor 102 is coupled to the second terminal of resistor 103, to node 108 and to pins TCLK, SIN, VSS, TRES, SCANMODE and TESTMODE of IC 101.

The present invention may be practiced with ALFDETO fuze IC produced by VLSI Technology, Inc.

FIGS. 2(A), 2(B), 2(C), 2(D), 2(E), 2(F), 2(G), 2(H), and 2(I) are diagrams illustrating a portion of the preferred embodiment of the present invention. Signal SOUT is present at terminal 201. Signal CLKOUT is present at terminal 202. Signal TCLK is present at terminal 203. Signal SIN is present at terminal 204. Signal TESTMODE is present at terminal 205. Signal SCANMODE is present at terminal 206. Signal POR is present at terminal 207. Signal TRES is present at terminal 208. Clock oscillator 209 provides output Clock to tristate buffer 212 and to an input of block 222. Terminal 203 provides signal TCLK to the input of buffer 213. The output of buffer 213 provides signal Test_Clock to an input of block 222. Signal Test_Mode is applied to an input of 222. The output of block 222 is coupled to the input of buffer 223. The output of buffer 223 provides signal Clock_128_kHz to block 225, to block 226, to block 239, to block 241, to block 243, to block 247, to block 253, to block 255 and to components illustrated in FIGS. 3(B), 3(D), 3(E), and 3(F).

Block 225 provides signal Timing_Clock[a] to an input of 3-input NAND gate 230, to an input of XOR gate 227 and to an input of 3-input AND gate 232. Block 225 provides signal Timing_Clock[b] to an input of 3-input NAND gate 230, to an input of XOR gate 227 and an input of 3-input AND gate 232. Block 225 provides signal Timing_Clock[c] to an input of 3-input NAND gate 230, to an input of AND gate 229 and to an input of 3-input AND gate 233. Block 225 provides signal Timing_Clock[d] to an input of 3-input AND gate 233. Block 225 provides signal Timing_Clock[e] to an input of 3-input AND gate 233. Block 225 provides signal Timing_Clock[f] to an input of AND gate 228 and to an input of 3-input AND gate 232.

The output of XOR gate 227 is coupled to an input of AND gate 228 and to an input of AND gate 229. The output of 3-input AND gate 232 is coupled to an input of OR gate 234. The output of 3-input AND gate 233 is coupled to an input of OR gate 234. AND gate 228 provides signal Clock_Out_Time to components illustrated on FIG. 3(B). AND gate 229 provides an signal Feedback_Start to components illustrated on FIG. 3.

The output of 3-input NAND gate 230 is coupled to the input of buffer 231 and to an input of block 225. An output of block 225 is coupled to an input of tristate buffer 211. The output of tristate buffer 211 is coupled to and provides signal SOUT at terminal 201. Signal Test_Mode is provided to an input of inverter 221. The output of inverter 221 is coupled to the select inputs of tristate buffer 211 and tristate buffer 212. The output of tristate buffer is coupled to and provides signal CLKOUT at terminal 202.

Figure 3A:
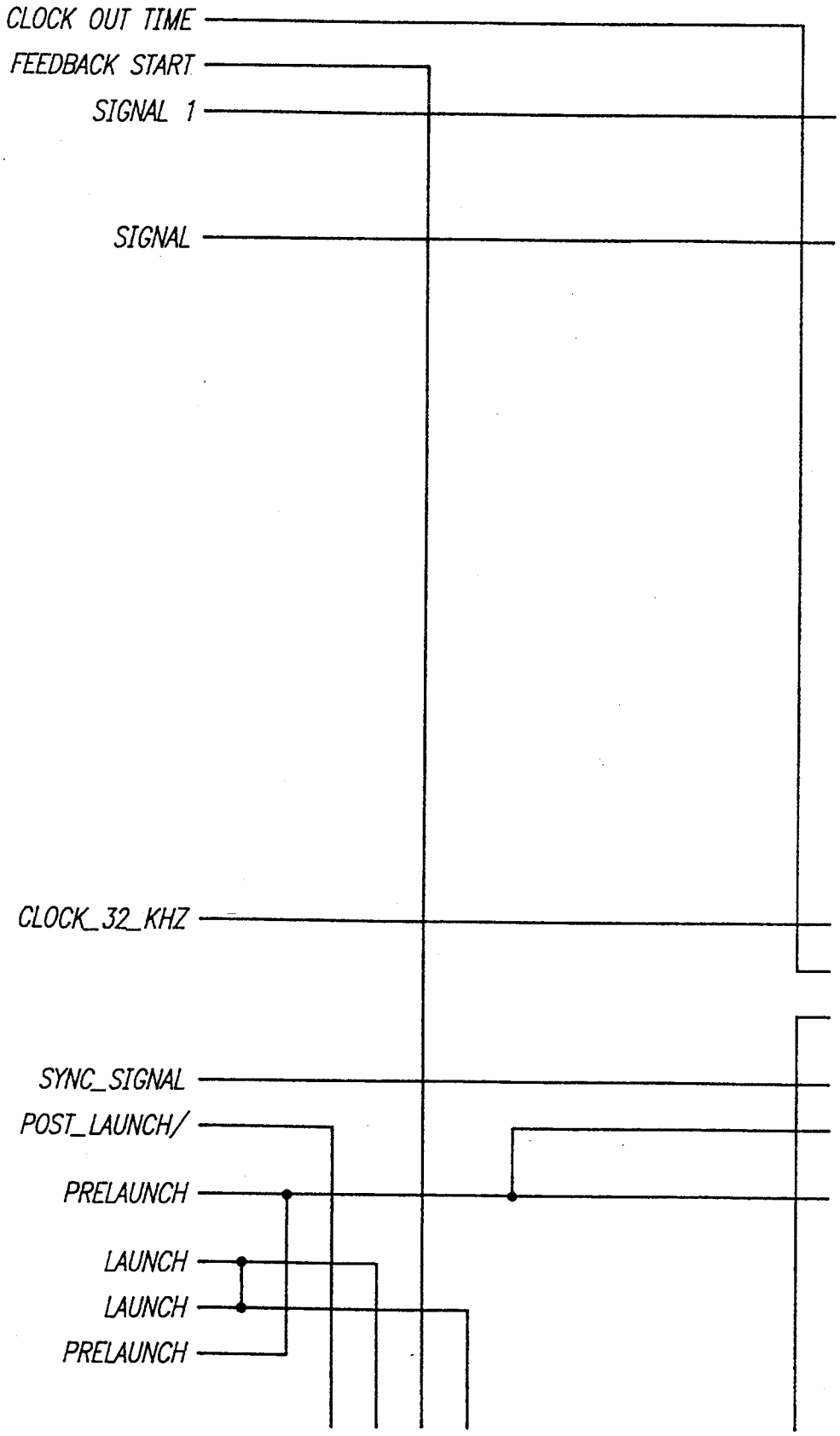
Figure 3B:
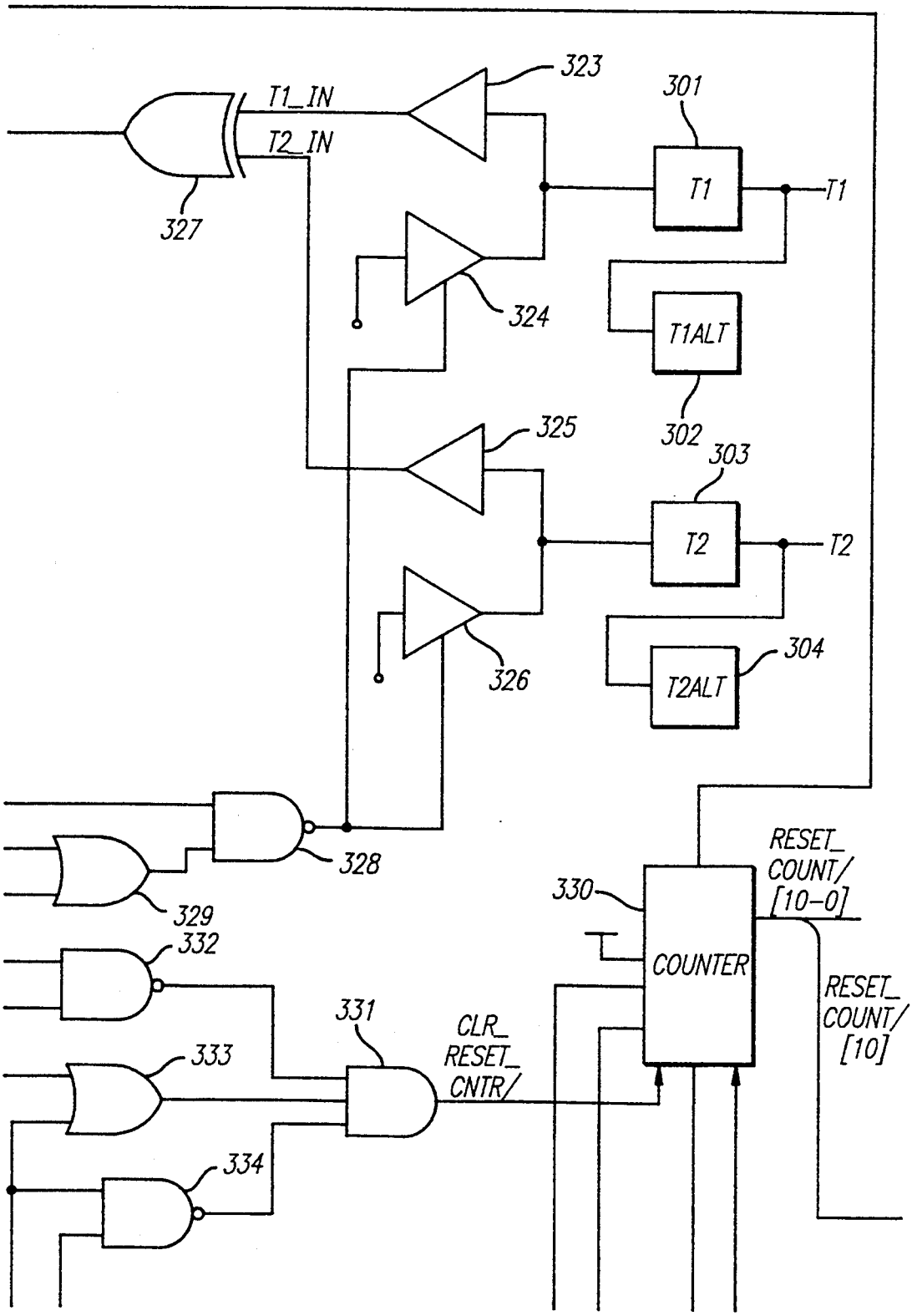
Figure 3C:
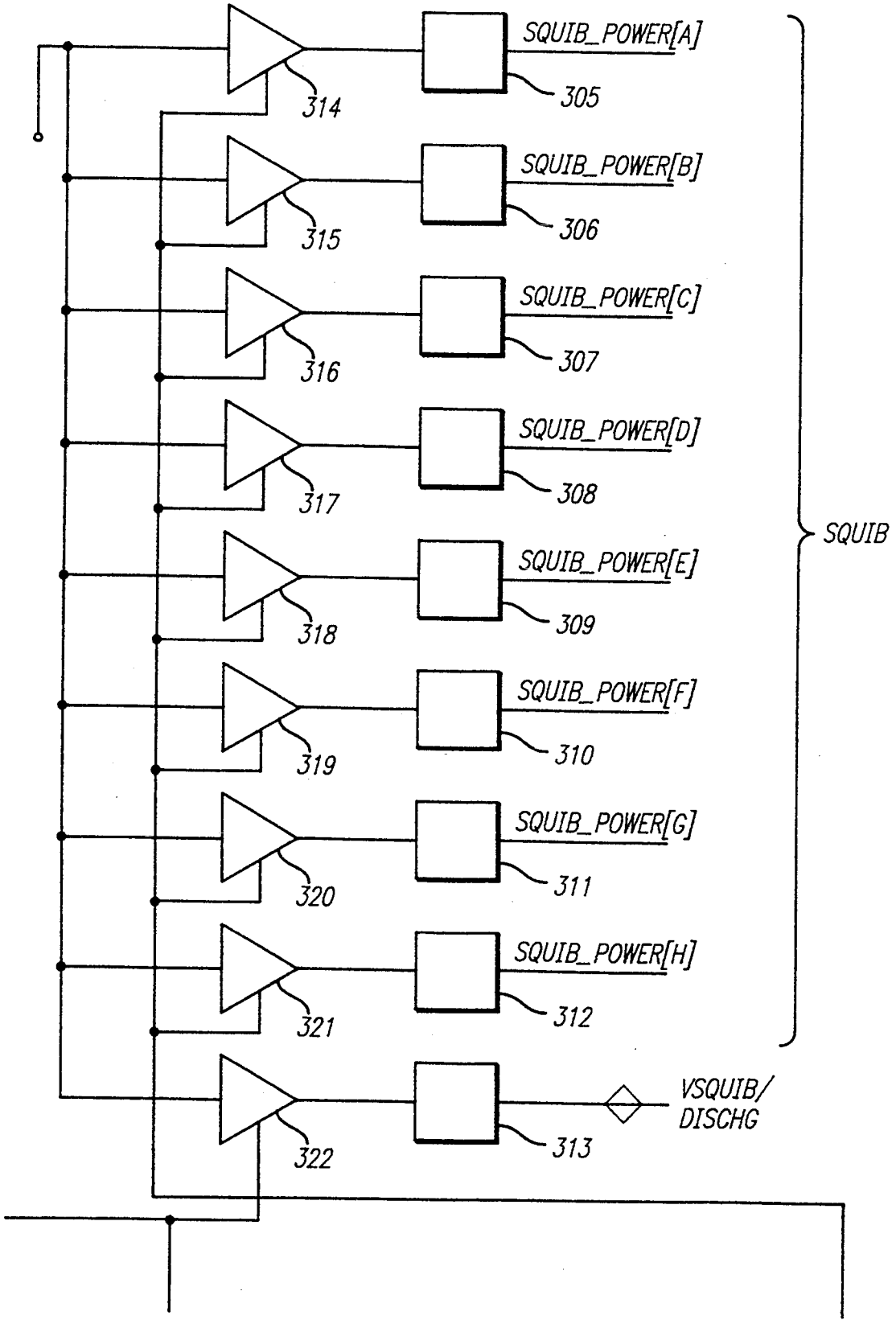
Figure 3D:
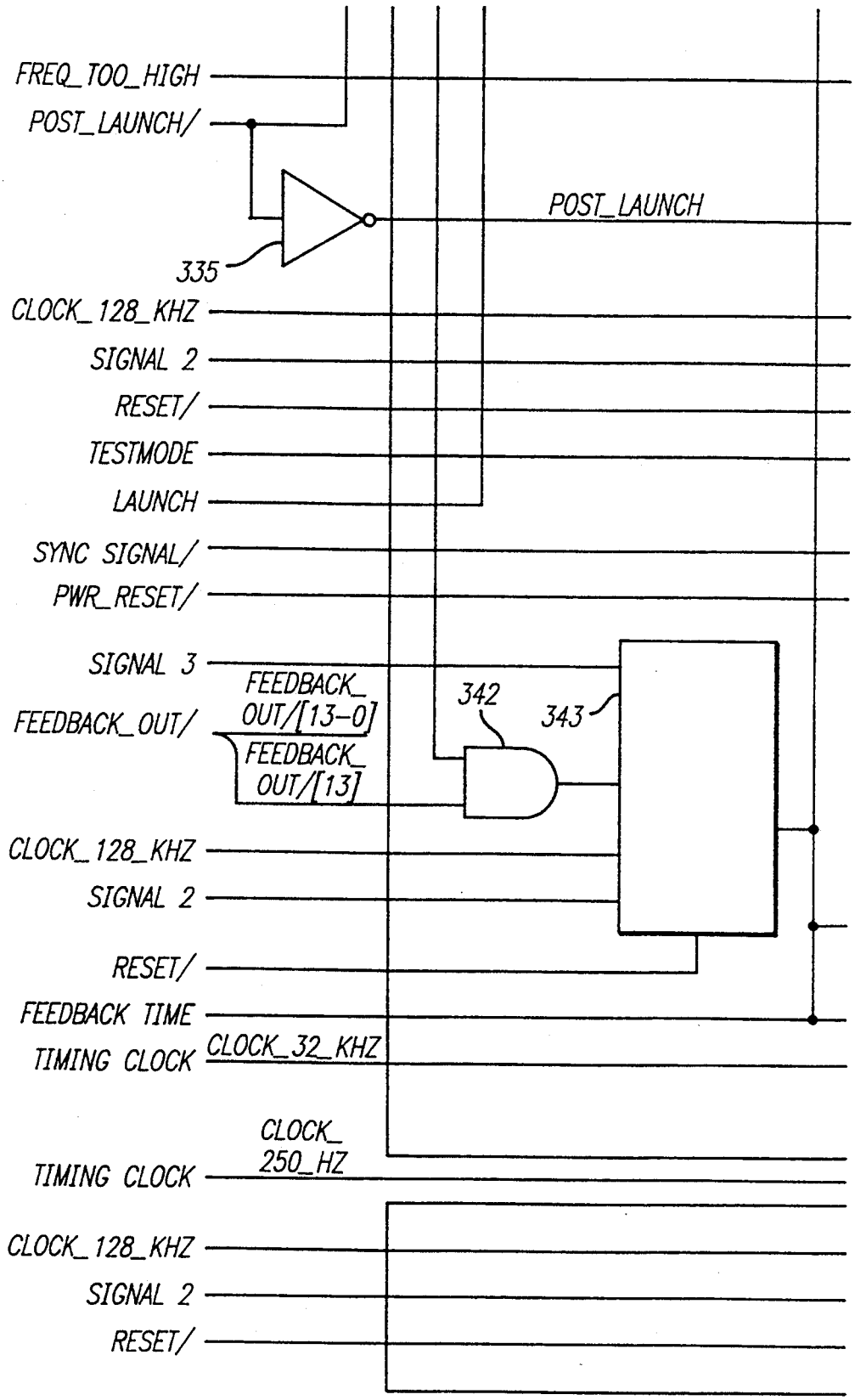
Figure 3E:
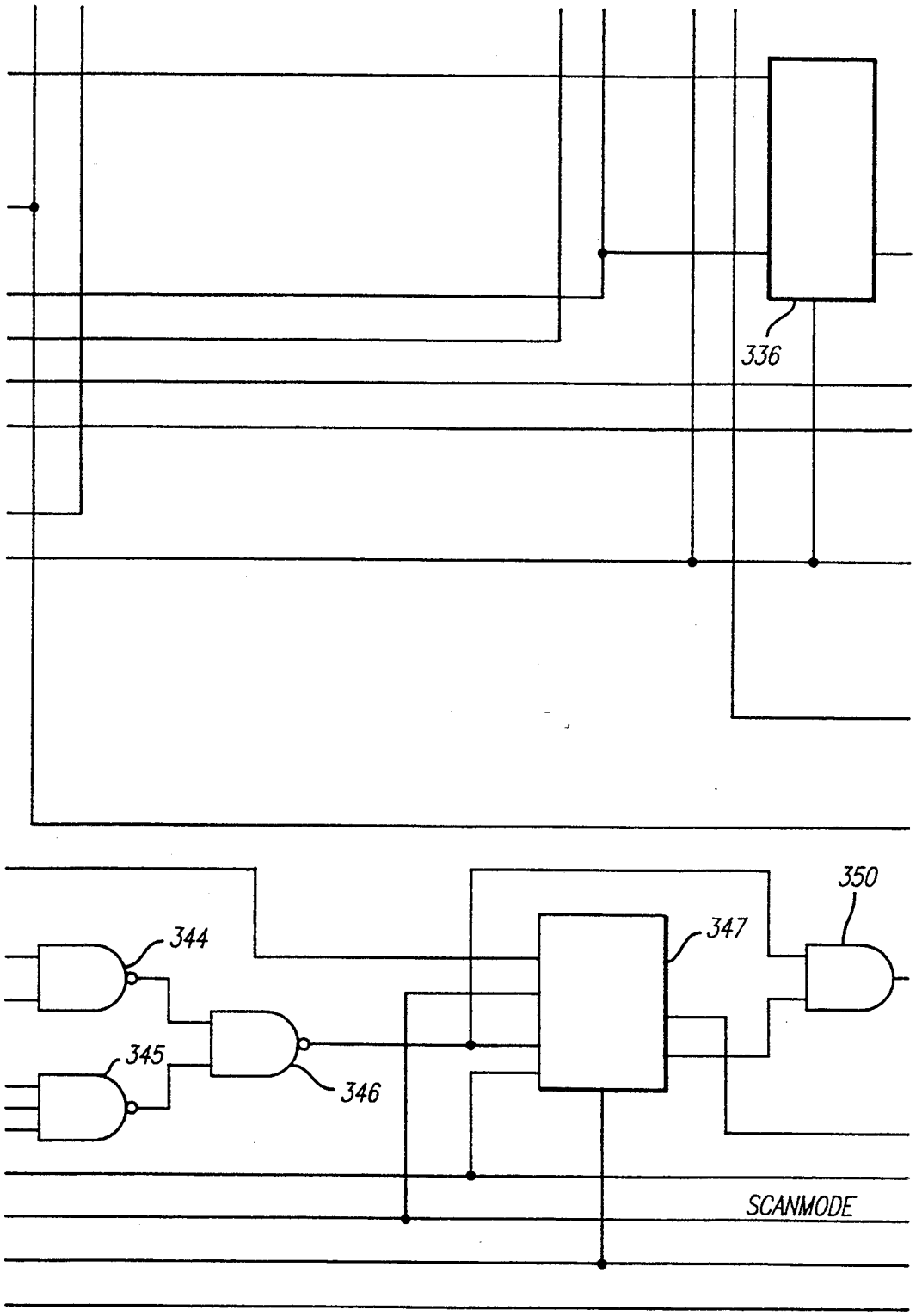
Figure 3F:
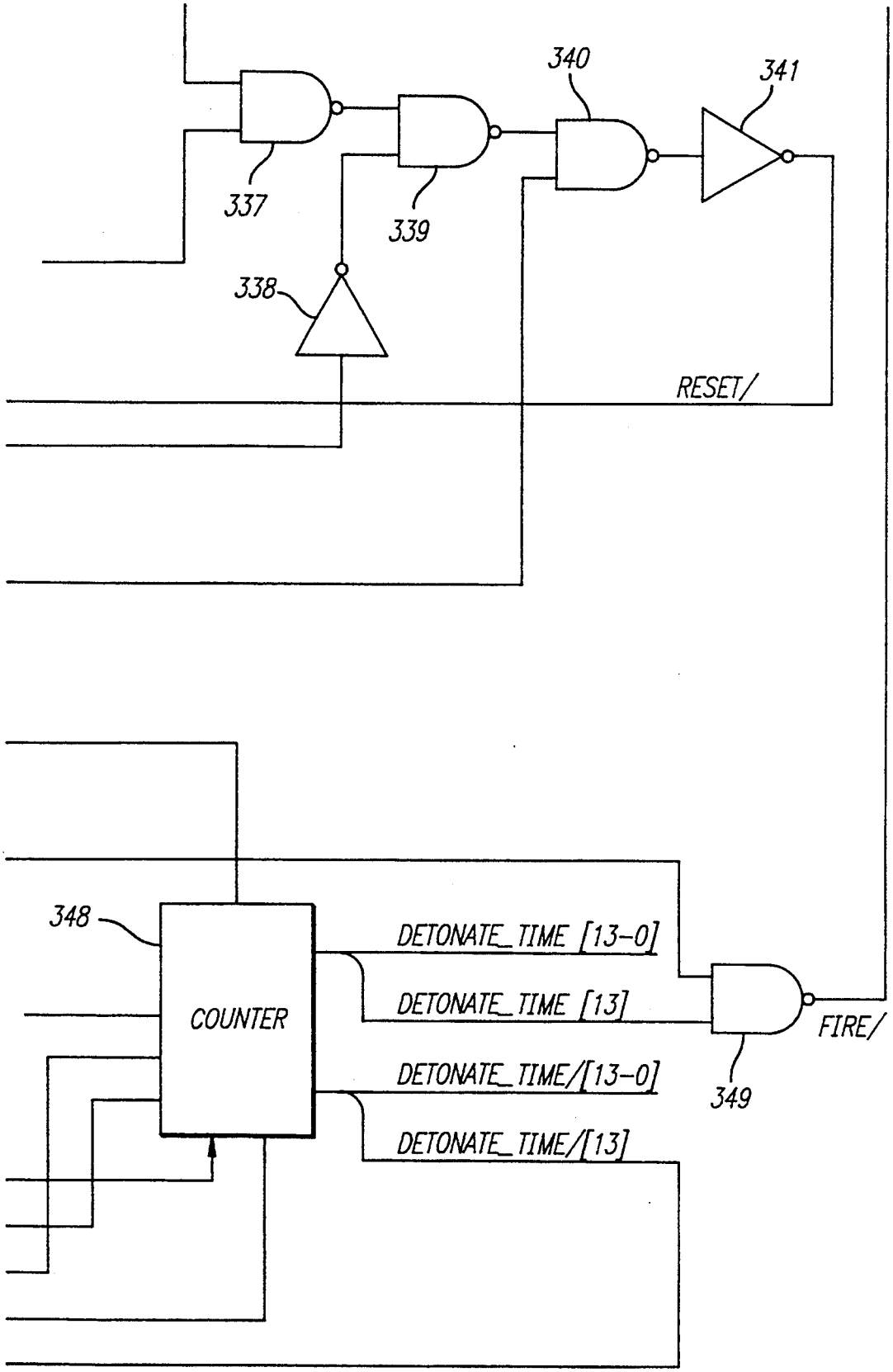

Block 225 provides signal Timing_Clock[g] to components illustrated on FIG. 3(E). Block 225 provides 32 kHz clock signal Timing_Clock[h], which is also known as Clock_32_kHz, to components illustrated on FIG. 3(E) and to an input of NAND gate 251. Block 225 provides signal Timing_Clock[i] to an input of 3-input NAND gate 235 and to an input of NAND gate 238. The signal Launch is applied to an input of NAND gate 235. The signal Post_Launch/is applied to an input of NAND gate 235. The signal Pre_Launch is applied to an input of NAND gate 236 and to an input of NAND gate 238.

The signal Sync_Signal is provided by block 226 to an input of block 225, to components illustrated in FIG. 3(B) and to an input of NAND gate 236. A signal Sync_Signal/, which is the complement of signal Sync_Signal, is provided by block 226 to an input of NAND gate 250 and to components illustrated in FIG. 3(B).

FIGS. 3(A), 3(B), 3(C), 3(D), 3(E), and 3(F) are diagrams illustrating a portion of the preferred embodiment of the present invention. FIGS. 3(A), 3(B), 3(C), 3(D), 3(E), and 3(F) are diagrams including terminals 301–313, tristate buffers 314–322, buffer 323, tristate buffer 324, buffer 325, tristate buffer 326, exclusive OR (XOR) gate 327, NAND gate 328, OR gate 329, counter 330, 3-input AND gate 331, NAND gate 332, OR gate 333, NAND gate 334, inverter 335, block 336, NAND gate 337, inverter 338, NAND gate 339, NAND gate 340, inverter 341, AND gate 342, block 343, NAND gate 344, NAND gate 345, NAND gate 346, block 347, block 348, NAND gate 349 and AND gate 350.

Signal T1 is present at terminal 301. Signal T2 is present at terminal 303. Signal Squib_Power[a] is present at terminal 305. Signal Squib_Power[b] is present at terminal 306. Signal Squib_Power[c] is present at terminal 307. Signal Squib_Power[d] is present at terminal 308. Signal Squib_Power[e] is present at terminal 309. Signal Squib_Power[f] is present at terminal 310. Signal Squib_Power[g] is present at terminal 311. Signal Squib_Power[h] is present at terminal 312. Signals Vsquib and Discharge_Capacitor are present at terminal 313.

Figure 4A:
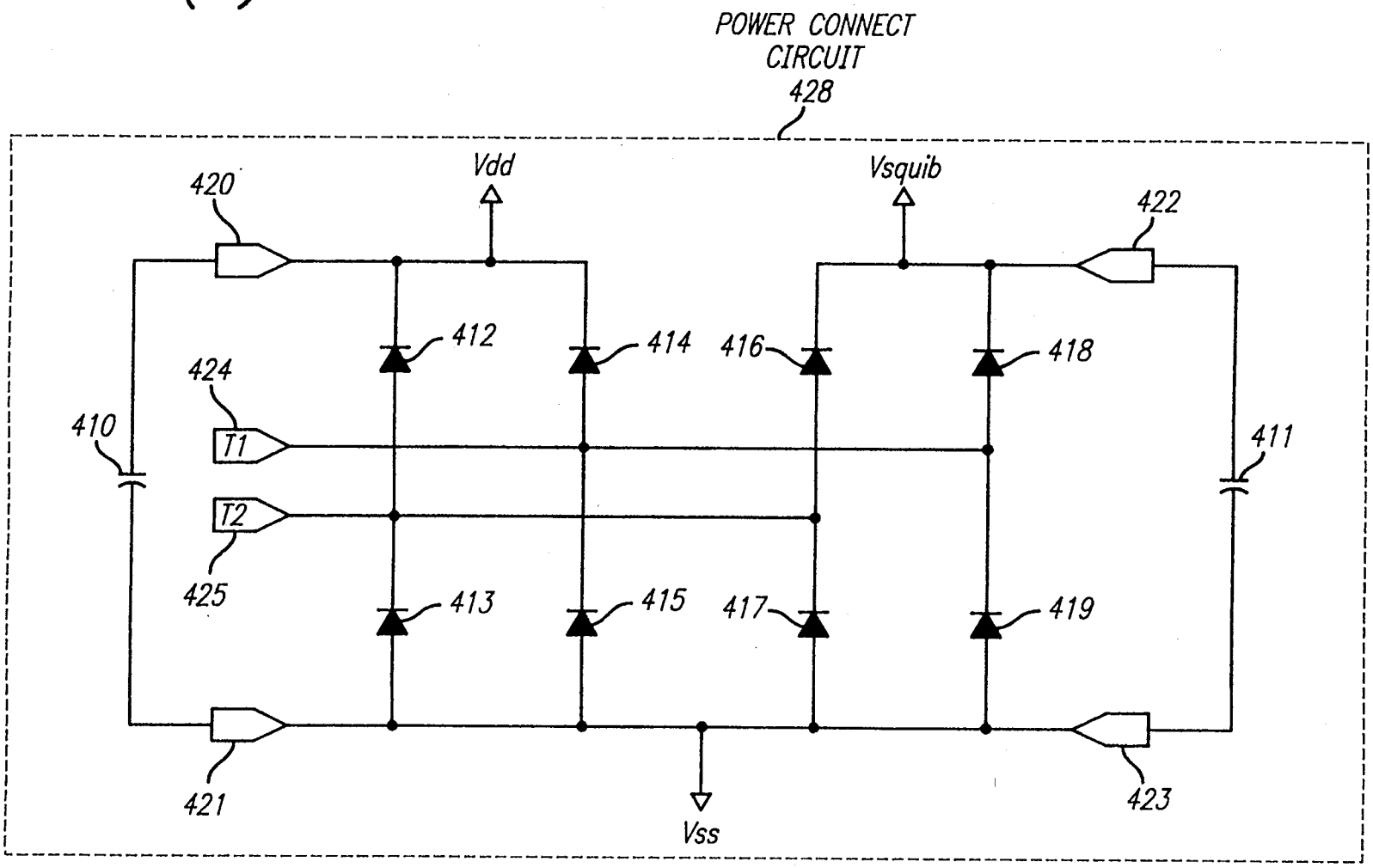
FIGS. 4(A) and 4(B) are block diagrams of the preferred embodiment of the present invention.
Figure 4B:
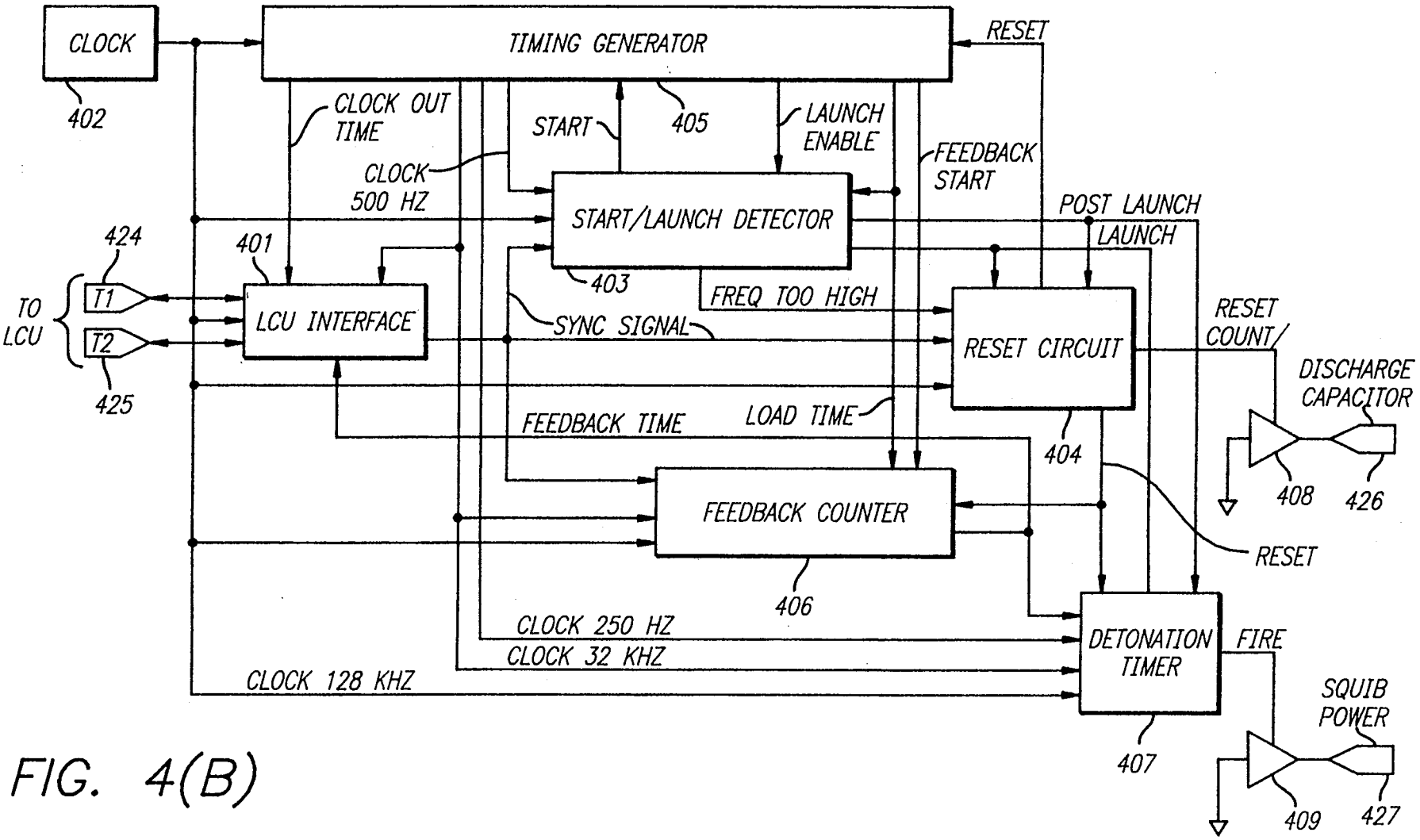

FIGS. 4(A) and 4(B) illustrate block diagrams of the preferred embodiment of the present invention. The block diagram includes LCU interface 401, clock 402, start/launch detector 403, timing generator 405, feedback counter 406, detonation timer 407, reset output driver 408, detonation output driver 409, energy storage capacitor 410, energy storage capacitor 411, diodes 412–419, connections 420–423, T1 connection 424, T2 connection 425, Discharge_Capacitor connection 426, Squib_Power connection 427, and power connect circuit 428.

T1 connection 424 and T2 connection 425 are coupled to LCU interface 401 and to an LCU. Clock circuit 402 provides clock signal Clock_128_kHz to timing generator 405, start/launch detector 403, LCU interface 401, reset circuit 404, feedback counter 406 and detonation timer 407. Timing generator 405 provides signal Clock_Out_Time to LCU interface 401. Timing generator 405 provides signal Clock_32_kHz to LCU interface 401, to feedback counter 406 and to detonation timer 407. Timing generator 405 provides signal Clock_500_Hz to start/launch detector 403. Start/launch detector 403 provides signal Start to timing generator 405. Timing generator 405 provides signal Launch_Enable to start/launch detector 403. Timing generator 405 provides signal Load_Time to start/launch detector 403 and to feedback counter 406. Timing generator 405 provides signal Feedback_Start 405 to feedback counter 406.

LCU interface 401 provides signal Sync_Signal to start/launch detector 403, reset circuit 404 and feedback counter 406. Start/launch detector 403 provides signal Freq_Too_High to reset circuit 404. Timing generator 405 provides signal Clock_250_Hz to detonation timer 407. Feedback counter 406 provides signal Feedback_Time to detonation timer 407 and to LCU interface 401. Start/launch detector 403 provides signal Post_Launch to reset circuit 404 and to detonation timer 407. Start/launch detector 403 provides signal Launch to reset circuit 404 and to detonation timer 407. Reset circuit 404 provides signal Reset to timing generator 405. Reset circuit 404 provides signal Reset to feedback counter 406 and detonation timer 407. Reset circuit 404 provides signal Reset_Count/to the control input of reset output driver 408. An input of reset output driver 408 is coupled to ground. The output of reset output driver 408 is coupled to Discharge_Capacitor connection 426. Detonation timer 407 provides signal Fire to the control input of detonation output driver 409. An input of detonation output driver 409 is coupled to ground. The output of detonation outrut driver 409 is coupled to Squib_Power connection 427.

Power connect circuit 428 includes capacitors 410 and 411, diodes 412–419, connections 420–423, T1 connection 424 and T2 connection 425. T1 connection 424 is coupled to the anode of diode 414, to the cathode of diode 415, to the anode of diode 418 and to the cathode of diode 419. T2 connection 425 is coupled to the anode of diode 412, to the cathode of diode 413, to the anode of diode 416 and to the cathode of diode 417.

The cathode of diode 414 is coupled to voltage output Vdd, to the cathode of diode 412 and through connection 420 to the more positive terminal of capacitor 410. The cathode of diode 416 is coupled to voltage output Vsquib, to the cathode of diode 418 and through connection 422 to the more positive terminal of capacitor 411. The anode of diode 413 is coupled to the anode of diode 415, to voltage output Vss, to the anode of diode 417, to the anode of diode 419, through connection 423 to the more negative terminal of capacitor 411 and through connection 421 to the more negative terminal of capacitor 410. The present invention may also be practiced by coupling voltage output Vsquib to voltage output Vdd, allowing the elimination of diodes 416–419, connections 422 and 423 and capacitor 411 from the circuit.

Figure 5:
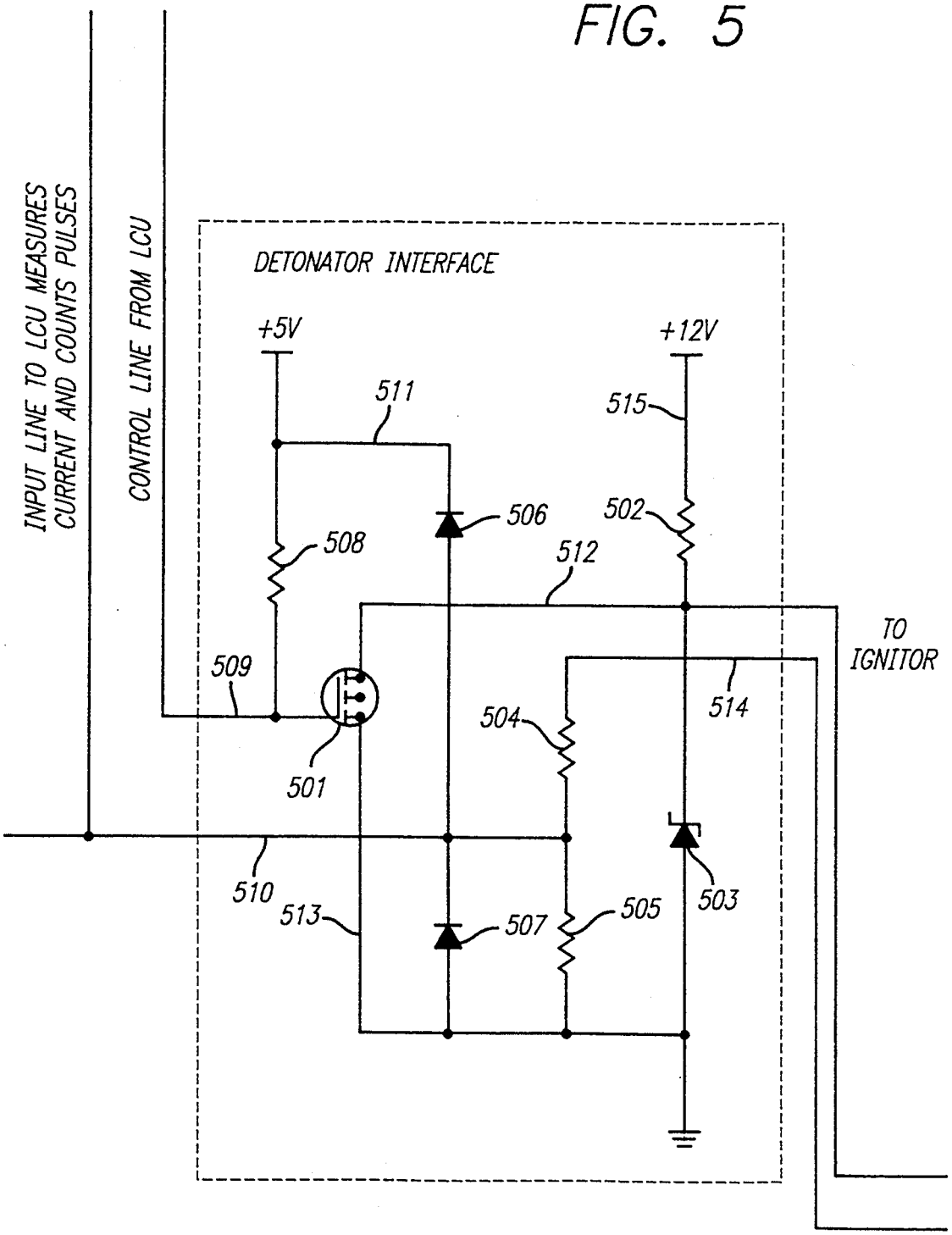
FIG. 5 is a schematic diagram of the preferred embodiment of the detonator interface of the LCU.

FIG. 5 is a diagram illustrating the preferred embodiment of the detonator interface circuit of an LCU. FIG. 5 includes field effect transistor (FET) 501, zener diode 503, diodes 506 and 507, resistors 502, 504, 505 and 508, and nodes 509, 510, 511, 512, 513, 514 and 515. A +12 V supply voltage is coupled through node 515 to a first end of resistor 502. The second end of resistor 502 is coupled to node 512, to a drain terminal of FET 501, to the cathode of zener diode 503 and to a first fuze lead. A second fuze lead is coupled through node 514 to a first terminal of resistor 504. The second terminal of resistor 504 is coupled to node 510, to a first terminal of resistor 505, to the anode of diode 506 and to the cathode of diode 507. The source terminal of FET 501, the anode of diode 507, the second terminal of resistor 505 and the anode of zener diode 503 are coupled to ground at node 513. A +5 V supply voltage is coupled through node 511 to a first terminal of resistor 508 and to the cathode of diode 506. The second terminal of resistor 508 is coupled to node 509, to gate terminal of FET 501 and to a control line from the LCU.

There are two parts of the detonator interface circuit that can cause current to flow. They are isolated from each other by diodes to prevent interference. When a fuze containing a discharged capacitor is connected to the detonator interface circuit across nodes 512 and 514, the capacitor will charge and current will flow. A +12 V supply voltage at node 515, in combination with resistor 502 and zener diode 503 will provide 7.5 volts across nodes 512 and 514 to charge the capacitor of the fuze. FET 501 may be used to short the output across nodes 512 and 514, reducing the voltage across nodes 512 and 514 to zero.

Resistors 504 and 505 form a voltage divider in the return path from the fuze to ground. The current flowing through the fuze circuit may be measured by measuring the voltage drop across resistor 505. This measurement may be made at node 510.

To charge the capacitor in the fuze, the fuze is connected across nodes 512 and 514 and FET 501 is turned off (placed in a non-conducting state). When this is done, 7.5 volts is applied across the fuze circuit. The current through fuze circuit is measured by coupling node 510 to the input of an analog-to-digital converter or some other analog voltage measurement device. Since an approximately exponentially decreasing current flow is expected as the capacitor in the fuze charges, deviations from the expected current flow may be used to detect a shorted fuze, an open fuze, or a fuze with a capacitor that has excessive leakage.

Current flow should substantially stop once the capacitor in the fuze is fully charged. When this stage is reached, another method may be used to induce current flow. The fuze may short nodes 512 and 514 to cause current to flow. The bridge rectifier circuit of the fuze prevents the capacitor of the fuze from being shorted when nodes 512 and 514 are shorted. Current flow may be detected by coupling node 510 to a digital input. The digital input can then distinguish a shorted condition from a non-shorted condition, allowing shorted and non-shorted conditions to be used to communicate binary data.

The signal from node 510 may be used to extract both analog and digital information by coupling it to both an analog measurement means and a digital input means.

Appendix A is a program listing of code for a LCU.

APPENDIX A

```
;.....................................................................
;
;                    IGNITOR  PROGRAM
;
; This routine requires the FULL ATTENTION of the LCU
;
; No interrupts are allowed except for timer1 overflow
; The LCU cannot communicate during this routine
;
; Since this routine could possibly be called during a multi-byte transmission
;  or reception, it is necessare to reset the serial port
;.....................................................................

gnitor_program:
        di
        set_485_command_receive

        ldb  mask_stash, int_mask
        ldb  mask_stash1, int_mask1
```

```
        ldb  int_mask, #TIMER1_OVERFLOW_INT_ENABLED
        ldb  int_mask1, #NO_INTS_ENABLED
        ei

        ;.....................................................................
        ; Also, if the tank is close to target pressure, turn off the valves.
        ; This is necessary because the pressure control routine is disabled
        ;  during ignitor programming.
        ;.....................................................................

        ldb  b0, target_pressure
        subb b0, tank_pressure
        cmpb b0, tank_critical_pressure
        jge  valves_ok

        turn_off_1 TANK_FILL_SOLENOID
        turn_off_1 TANK_VENT_SOLENOID

valves_ok:

        ;.....................................................................
        ;
        ;     Ignitor wakeup
        ;
        ; The ignitor requires 32 pulses at 32khz to wake up
        ; This routine sends a lot more, just to be safe
        ;
        ;.....................................................................


        ;---- Just for a little extra safety, reset the ignitor

        call ignitor_reset

        ;---- Send the wakeup

        ld   pulse_time, IGNITOR_WAKEUP_32KHZ
        ld   pulse_count, #IGNITOR_WAKEUP_PULSES ;Number of periods to send
        call pulse_train_sub

        ;---- Wait for ignitor to respond with 8192 (2000H) pulses

        clr  timer_2                    ;Counts ignitor pulses
        clr  t1_overflow_count          ;t1 measures real time

wait_for_edge_1:
        ;---- Wait for first pulse, it will be a logic high

        jbs  P2, 3, edge_found_1

        ;---- PET DOG

        cmp  t1_overflow_count, #5      ;Check for 0.5 second timeout
        jlt  wait_for_edge_1

        ldb  ignitor_error, #WAKEUP_TIMEOUT
        sjmp ignitor_failed

edge_found_1:
        get_timer_1 clock_out_time      ;Beginning of ignitor
                                        ;   clock_out cycle
wait_for_reply:
        ;---- Wait for 2000H pulses, counted as 4000H rise/fall edges

        cmp  timer_2, #4000H
        jlt  check_time
```

```
        jgt  count_bad

        sjmp ignitor_reply_received

check_time:
        ;---- PET DOG

        cmp  t1_overflow_count, #10    ;Check for 1 second timeout
        jlt  wait_for_reply

count_bad:
        ldb  ignitor_error, #WAKEUP_COUNT_BAD
        sjmp ignitor_failed

   ;--- The reply was received correctly

   ignitor_reply_received:
        get_timer_1 clock_out_window
        sub  clock_out_window, clock_out_time
        subc clock_out_window+2, clock_out_time+2

    ;---- Compute count fixup
    ;---- Window time is 2000H ignitor clock pulses & therefore
    ;        directly related to ignitor clock frequency
    ;---- Ideal window 250 msec = 156,250 t1 timer counts @ 10MHz
    ;---- Ignitor resolution is 256 counts per second of delay
    ;---- Calibrated count
    ;      =[(ideal window count)/(measured window count)] * 256*(delay/1000)
    ;      = 40,000 * delay / 4*(measured window count/4)
    ;      = 10,000 * delay / (measured window count/4)
    ;      if delay is in msec.  Divide by 4 to use a word divisor

        ld   L0, clock_out_window
        ld   L0+2, clock_out_window+2
        shrl L0, #2                    ;Divide by 4 to produce 16 bit word

        mulu L1, ignitor_delay, #IGNITOR_COUNT_MULTIPLIER
        divu L1, L0
        ld   ignitor_cal_count, L1     ;Corrected count

        shrl L0, #8
        ldb  ignitor_period, L0        ;Send back to host computer

   ;--- If the ignitor frequency is way out of spec
   ;     cal count will become excessively large

        cmp  ignitor_cal_count, #IGNITOR_MAX_COUNT
        jle  cal_count_ok

        ldb  ignitor_error, #CAL_COUNT_BAD
        sjmp ignitor_failed

   cal_count_ok:
        ;Send corrected count to ignitor
        ld   pulse_time, L0
        ld   pulse_count, ignitor_cal_count
        call pulse_train_sub

   ;--- Ignitor will return (2000H-ignitor_cal_count) pulses
        clr  timer_2                   ;Counts ignitor pulses

   ;--- Wait for first pulse, it will be a logic high

   wait_for_edge_2:
        jbs  P2, 3, edge_found_2       ;Wait for t2_clk input low
```

```
     ;---- PET DOG

     cmp  t1_overflow_count, #15   ;Check for 1.5 sec timeout
     jlt  wait_for_edge_2

     ldb  ignitor_error, #RESPONSE_TIMEOUT
     sjmp ignitor_failed

edge_found_2:
     get_timer_1 feedback_time     ;Beginning of ignitor
                                   ;   feedback_time cycle
     ld   feedback_window, feedback_time
     ld   feedback_window+2, feedback_time+2
     add  feedback_window,clock_out_window
     addc feedback_window+2,clock_out_window+2

wait_for_window:
;--- Wait one ignitor clock_out_window duration
     ;---- PET DOG

     get_timer_1 L0                    ;L0 gets current time
     cmpl L0, feedback_window
     jlt  wait_for_window

     ld   ignitor_returned_count, timer_2
     shr  ignitor_returned_count,#1          ;Divide by 2 to convert edge
                                             ; count to pulse count

;--- Check returned count for correctness

     add  ignitor_returned_count, ignitor_cal_count

     cmp  ignitor_returned_count, #IGNITOR_MAX_COUNT
     je   response_ok

     ldb  ignitor_error, #RESPONSE_COUNT_BAD
     sjmp ignitor_failed

response_ok:
     ldb  ignitor_state, #PROGRAMMED
     ldb  ignitor_error, #NO_ERROR

     clr  timer_2              ;Counts ignitor pulses
                               ;Used in timer_int to count
                               ;   noise pulses
     sjmp ignitor_program_end

ignitor_failed:                ;Reset ignitor
     call ignitor_reset

ignitor_program_end:

;--- Restore the normal interrupt state

     ldb  B0, serial_status
     ldb  B0, serial_data
     clrb int_pend1

     ldb  int_mask, mask_stash
     ldb  int_mask1, mask_stash1

     set_485_command receive
     clrb comm_error
     ei

     ret
```

```
;.....................................................................
;                    I G N I T O R   L A U N C H
;
; Send arm signal (ignitor clock frequency X 1.75) to begin ignitor countdown.
; Then open the butterfly to launch shell.
; The butterfly is not closed by this routine
;
; Since this routine could possibly be called during a multi-byte transmission
;  or reception, it is necessare to reset the serial port
;.....................................................................

ignitor_launch:
        di
        set_485_command_receive

        ld   L0, clock_out_window
        ld   L0 + 2, clock_out_window + 2
        shrl L0, #11
        ld   pulse_time, L0
        shrl L0, #3
        add  pulse_time, L0

        ld   pulse_count, #IGNITOR_ARM_PULSES

        call pulse_train_sub

        ldb  ignitor_state, #ARMED

        ;Fix the serial port

        ldb  B0, serial_status
        ldb  B0, serial_data
        clrb int_pend1

        clrb comm_error

        ei

        ret


        ;.....................................................................
        ;
        ;                    P U L S E   T R A I N
        ;
        ;.....................................................................


pulse_train_sub:
        shl  pulse_count, #1                ;Count x 2 for half periods

        shr  pulse_time, #1                 ;Time / 2 for half period
        sub  pulse_time, #30                ;Minimum state times in delay loop
        shr  pulse_time, #1                 ;2 state times per nop
        ld   pulse_index, pulse_min_address
        sub  pulse_index, pulse_time

        di

        cmp  pulse_index, pulse_max_address
        jge  pulse_not_too_long

        ldb  ignitor_error, #FREQ_TOO_LOW
        sjmp pulse_end

pulse_not_too_long:
```

```
        cmp  pulse_index, pulse_min_address
        jle  pulse_min

        ldb  ignitor_error, #FREQ_TOO_HIGH

        sjmp pulse_end

pulse_max:
        nop
        nop
        nop
        nop
        nop
        nop
        nop
        nop
        nop
        nop

        nop
        nop
        nop
        nop
        nop
        nop
        nop
        nop
        nop
        nop

        nop
        nop
        nop
        nop
        nop
        nop
        nop
        nop
        nop
        nop

        nop
        nop
        nop
        nop
        nop
        nop
        nop
        nop
        nop
        nop

        nop
        nop
        nop
        nop
        nop
        nop
        nop
        nop
        nop
        nop

        nop
        nop
        nop
```

```
pulse_min:
        nop
        nop
        ;---- PET DOG

        xorb P2,#IGNITOR_SHORTED          ;Toggle output (4 state times)

        dec  pulse_count                      ;3 state times
        je   pulse_end                    ;4 state times
        br   [pulse_index]                ;7 state times

pulse_end:
        clear_bit P2, IGNITOR_SHORTED     ;Turn output on to keep ignitor powered

        ei

        ret

        ;.....................................................................
        ;
        ; I G N I T O R    R E S E T
        ;
        ; Short ignitor input leads to force a ignitor reset
        ;.....................................................................

ignitor_reset:
        ld   W0, #IGNITOR_RESET_DURATION

   ignitor_reset_loop:
        set_bit P2, IGNITOR_SHORTED           ;Short output

        dec  W0                           ;Keep output shorted for
        jne  ignitor_reset_loop           ;   a short time

        clear_bit P2, IGNITOR_SHORTED     ;Apply full voltage out
        ldb  ignitor_state, #POWERED

        ret


pulse_min_address:
        dcw  pulse_min
pulse_max_address:
        dcw  pulse_max
```

We claim:

1. A method of initiating an explosion comprising the steps of:

providing a charging current from a control means to a detonating means having a capacitor, said charging current to charge said capacitor;

providing a start command from said control means to said detonating means;

providing a first clock signal at a first frequency from said detonating means to said control means;

determining said first frequency at said control means and providing a time delay signal to said detonating means based on said first frequency, said time delay signal controlling a time delay between a launch command and a detonate command;

providing said launch command from said control means to said detonating means;

providing said detonation command at said detonating means when said time delay has occurred and said detonating means is not connected to said control means;

resetting said detonating means when said detonating means is connected to said control means after a portion of said time delay has expired.

2. The method of claim 1 wherein said first frequency is approximately one fourth a second frequency, said second frequency being an operating frequency of said detonating means.

3. The method of claim 1 further including the step of masking inputs of said detonating means after said launch command is received.

4. The method of claim 1 wherein said portion of said time delay is approximately 416 milliseconds.

5. The method of claim 1 wherein said time delay is determined by implemented by storing a load count in said detonating means.

6. The method of claim 5 wherein said load count is determined by:

load count=(time delay in miliseconds/1000)*(256 pulses/second)* (256 milliseconds/measured time);

where;

time delay in milliseconds=a desired time delay between launch and detonation;

measured time=amount of time measured by said control means during transmission of said first clock signal by said detonating means.

7. A circuit for providing a detonation signal comprising:

interface means for interfacing said circuit to a control means; said interface means being bi-directional and non-polarized;

a clock;

timing generating means coupled to said clock, said timing generating means for generating a plurality of timing signals;

state detecting means coupled to said interface means and to said timing generating means; said state detecting means for detecting commands from said control means and for selecting one of a plurality of states of said circuit;

resetting means coupled to said interface means, said state detecting means and said timing generating means for resetting said circuit;

feedback counting means coupled to said interface means and to said timing generating means; said feedback counting means for receiving a timing count from said control means and for providing an output count signal;

detonation timer means coupled to said feedback counting means for storing a count based on said output count received from said feedback counting means;

energy storage means for storing energy for initiating a detonation, said energy storage means coupled to said interface means.

8. The circuit of claim 7 wherein said interface means comprises a signal T1 connection and a signal T2 connection coupled to inputs of an XOR gate.

9. The circuit of claim 7 wherein said plurality of states comprises a start state, a pre-launch state, a launch state, and a post launch state.

10. The circuit of claim 7 wherein said output count signal of said feedback counting means comprises 8,192 pulses.

11. The circuit of claim 7 wherein said detonation timer means comprises a counter.

12. The circuit of claim 11 wherein said detonation timer means provides a delay time output when a launch signal is received by said interface means.

13. The circuit of claim 12 wherein said detonation timing means enables a detonation signal when said delay time has expired.

14. The circuit of claim 7 wherein said energy storage means comprises a capacitor.

15. The circuit of claim 14 wherein said capacitor is charged with a charging current from said control means.

16. The circuit of claim 13 wherein said energy storage means releases said stored energy when said detonation signal is enabled.

* * * * *